US010231049B2

(12) United States Patent
Spero

(10) Patent No.: US 10,231,049 B2
(45) Date of Patent: Mar. 12, 2019

(54) LOUDSPEAKER, LOUDSPEAKER DRIVER AND LOUDSPEAKER DESIGN PROCESS

(71) Applicant: Marcus Christos Spero, Helensvale (AU)

(72) Inventor: Marcus Christos Spero, Helensvale (AU)

( * ) Notice: Subject to any disclaimer, the term of this patent is extended or adjusted under 35 U.S.C. 154(b) by 0 days.

(21) Appl. No.: 15/812,833

(22) Filed: Nov. 14, 2017

(65) Prior Publication Data

US 2018/0146281 A1 May 24, 2018

(30) Foreign Application Priority Data

Nov. 15, 2016 (AU) ..... 2016904649

(51) Int. Cl.

| | |
|---|---|
| ***H04R 1/02*** | (2006.01) |
| ***H04R 1/24*** | (2006.01) |
| ***H04R 1/26*** | (2006.01) |
| ***H04R 1/28*** | (2006.01) |
| ***H04R 3/14*** | (2006.01) |

(52) U.S. Cl.

CPC ..... *H04R 1/24* (2013.01); *H04R 1/025* (2013.01); *H04R 1/2803* (2013.01); *H04R 3/14* (2013.01); *H04R 1/26* (2013.01); *H04R 1/288* (2013.01); *H04R 1/2888* (2013.01); *H04R 2201/029* (2013.01)

(58) Field of Classification Search

CPC ..... H04R 1/2803; H04R 1/288; H04R 1/02; H04R 1/28; H04R 1/2819; H04R 1/2826; H04R 2201/029; H04R 1/2811; H04R 1/24; H04R 1/2865; H04R 1/38; H04R 1/406; H04R 25/402; H04R 25/405; H04R 25/65; H04R 7/06; G10K 9/121; G10K 15/10; G10K 9/10

USPC ..... 381/332, 335, 150, 337, 345, 349, 300, 381/87, 89, 98, 99, 386; 181/175, 198, 181/199, 148, 146, 151

See application file for complete search history.

(56) References Cited

U.S. PATENT DOCUMENTS

| | | | | | |
|---|---|---|---|---|---|
| 3,952,159 | A * | 4/1976 | Schott | H04R 1/2819 | 181/156 |
| 4,128,738 | A * | 12/1978 | Gallery | H04R 1/2819 | 181/146 |
| 4,450,929 | A * | 5/1984 | Marrs | H04R 1/26 | 178/90 |
| 5,661,271 | A * | 8/1997 | Moser | H04R 1/02 | 181/199 |

* cited by examiner

*Primary Examiner* — Lun-See Lao

(74) *Attorney, Agent, or Firm* — Kirton McConkie; Evan R. Witt

(57) ABSTRACT

The invention relates in general to the field of high fidelity audio reproduction and to the design process and selection of a sealed loudspeaker for the home and audiophile markets. The sealed loudspeaker has at least one professional sound reinforcement driver, a crossover network, a sealed enclosure, and the enclosure volume is less than 300 liters. The at least one professional sound reinforcement driver has a small compliance volume (Vas) or a large system compliance ratio (α) for a total system quality of between 0.5 and 1.0.

20 Claims, 14 Drawing Sheets

LOUDSPEAKER, LOUDSPEAKER DRIVER AND LOUDSPEAKER DESIGN PROCESS

FIELD OF THE INVENTION

The invention relates in general to the field of high fidelity audio reproduction and to the design process and selection of a sealed loudspeaker. In particular, the invention relates to the design of a sealed high fidelity loudspeaker using professional sound reinforcement drivers which can be used for the audiophile and home user environment.

The invention also extends to the design of a loudspeaker driver with a low frequency cut-off, high efficiency and good transient response which can be housed in a sealed enclosure suitable for the audiophile and home environment.

BACKGROUND OF THE INVENTION

It should be noted that reference to the prior art herein is not to be taken as an acknowledgement that such prior art constitutes common general knowledge in the art.

Where high fidelity reproduction of sound is required, many requirements must be met. The most basic of these requirements is that the loudspeaker must be designed to reproduce all of the human audible frequency range. Therefore, a loudspeaker is an electroacoustic transducer which converts an electrical audio signal into a corresponding sound. A loudspeaker for the audiophile or home user will typically include an enclosure in which speaker drivers and associated electronic hardware, such as crossover circuits, are mounted. The simplest of enclosures are designed from rectangular particle-board boxes. The very complex loudspeaker cabinets can incorporate composite materials, internal baffles, horns, ports and acoustic insulation.

The enclosure housing provides a resonance space. One of the fundamental requirements for designing a loudspeaker is to achieve a low resonant frequency in a speaker enclosure that has a relatively small internal volume and this comes at a compromise. With the loudspeaker transducer mounted within an enclosure or box the ability to reproduce sound is dependent on the interaction of the motion of the transducer to the acoustic behaviour of the enclosure.

Sealed loudspeaker design has always been difficult due to the reduction in low frequency efficiency of the transducer when placed in an enclosure. This inefficiency, coupled with the large enclosure needed to match the performance of a typical modestly sized ported design has resulted in sealed designs being relatively rare and in particular in the audiophile and home user market. However, one advantage of using a sealed design is the accurate time-domain step response and a far gentler low frequency (LF) roll-off. Using a sealed enclosure also provides a usable output which extends to a much lower frequency.

The use of professional sound reinforcement drivers (PA Drivers) was designed to reinforce sound to make it louder or distribute it to a wider audience. Therefore, professional sound reinforcement (PA) drivers are defined as drivers designed for large scale and large area applications including performance halls, cinemas, clubs, concerts, places of worship and outdoor venues. A PA bass driver or woofer when compared with its Hi-Fi equivalent is physically much larger in size. Professional sound reinforcement drivers designed for low frequency bass reproduction to the lowest octave of the audible spectrum are 15, 18 and 21 inches in diameter and almost always employ a surround that is of the accordion type giving rigidity. These drivers also have a large power handling and lower compliance suspension system (in comparison to Hi Fi speakers) with the resonant frequency ($F_s$) of the driver being higher as a compromise. Therefore for these drivers to operate effectively requires either very large enclosures and/or ported enclosure designs.

Where high fidelity reproduction of sound is required, multiple loudspeaker transducers are often mounted in the same enclosure, each reproducing a part of the audible frequency range.

Clearly it would be advantageous if a sealed loudspeaker and loudspeaker driver could be devised that helped to at least ameliorate some of the shortcomings described above. In particular, it would be beneficial to provide a sealed loudspeaker, loudspeaker driver and design process for producing loudspeakers and drivers which utilised professional sound reinforcement (PA) drivers to produce a loudspeaker which was suitable for the audiophile and home environment.

SUMMARY OF THE INVENTION

In accordance with a first aspect, the present invention provides a sealed loudspeaker for the home and audiophile markets, the loudspeaker comprising: at least one professional sound reinforcement driver; a crossover network; a sealed enclosure; and wherein the enclosure has a volume of less than 300 liters and the at least one professional sound reinforcement driver is a bass driver which has a compliance volume (Vas) in the range of 140 to 1800 Liters, a system compliance ratio ($\alpha$) less than 7.0, and a reference efficiency greater than 1.5% for a total system quality of between 0.5 to 1.0.

Preferably, the enclosure volume may be less than 250 liters.

Preferably, the total system quality may be 0.707.

Preferably, the bass drivers may have a driver diameter of between 15 inches to 21 inches.

Preferably, the crossover network may be designed using any of the known filter designs. The crossover network may be designed using either a Butterworth or Linkwitz-Riley design.

Preferably, the loudspeaker may be a 2-way speaker comprising the bass driver and a tweeter or coaxial driver selected from the professional sound reinforcement drivers. The tweeter driver may be selected to match the bass driver's characteristics including, power handling, usable frequency to ensure complete audio spectrum is covered, dispersion characteristics, and high frequency sensitivity to align with the bass driver sensitivity.

Alternatively, the loudspeaker may be a 3-way speaker comprising the bass driver, a midrange driver and a tweeter driver selected from the professional sound reinforcement drivers. The midrange and tweeter drivers may be selected to match the bass drivers characteristics including, power handling, usable frequency to ensure complete audio spectrum is covered, dispersion characteristics, and midrange and high frequency sensitivities to align with the bass driver sensitivity.

Preferably, the bass driver may have a sealed cut-off frequency of less than 70 Hz for an enclosure volume of less than 400 Liters. The bass driver may have a free air resonant frequency (Fs) of less than 40 Hz with a reference efficiency of greater than 1.5% and a flat response to a target frequency of 50 Hz in a sealed enclosure limited to a volume of less than 250 Liters. The bass driver may provide a 70 Hz or below cut-off frequency in a sealed enclosure of less than 250 Liters with a total quality of the system (Qtc) of between 0.5 and 1.0. The bass driver may further comprise a Zobel network connected in parallel with the bass driver in order to compensate for the bass driver's voice coil inductance and thus ensure a predictable crossover frequency.

Preferably, the tweeter driver may be selected from any one of a compression driver, an air motion transformer, a horn loaded piezoelectric tweeter, a dome tweeter, a cone tweeter or a conventional ribbon tweeter.

Preferably, the midrange driver may be selected from any one of a closed back midrange driver, compression driver, an open back midrange driver, or an air motion transformer.

Preferably, the enclosure may comprise, a cabinet housing the at least one professional sound reinforcement driver to project sound from the cabinet while leaving a space inside the cabinet that is unoccupied by the at least one professional sound reinforcement driver; and wherein the cabinet and the at least one professional sound reinforcement driver form a sealed enclosure.

Preferably, the enclosure may further comprise a damping material mounted in the space inside the cabinet to minimise internal resonances. The damping material may be a polyester textile fibre, foam, rubber or fibre reinforced plastic that is wrinkle-resistant and strong or a combination of these materials.

Preferably, the cabinet may be formed in any shape. For example, the cabinet could be shaped as a sphere. Alternatively, the cabinet may have at least two walls, the at least two walls having the same or different-sized wall surfaces and/or the at least two walls are formed parallel to one another or not parallel to one another. Further alternatively, the cabinet may be shaped as a rectangular box to reduce baffle diffraction effects. The rectangular box may further comprise at least one bevelled edge on a front surface of the cabinet. Alternatively, all edges of the front surface of the cabinet may be bevelled.

Preferably, the cabinet may further comprise internal bracing to minimise the amplitude of vibration when exposed to a time varying internal pressure.

Preferably, the cabinet and the internal bracing may be manufactured from a medium-density fibreboard or plywood and an external surface of the rectangular box is covered with any one or more of a thin decorative covering such as a veneer or a covering finish such as carpet, varnish or paint. Alternatively, the cabinet and the internal bracing may be manufactured from a mixture of solid timber such as birch wood and birch plywood. Further alternatively, the cabinet and the internal bracing may be manufactured from a plastics material or any other suitable material which provides a cabinet with walls that are strong such that resonances and unwanted vibrations are well damped.

Preferably, the cabinet, the internal bracing and the at least one professional sound reinforcement driver mounted in the cabinet may be all mounted, sealed and screwed in place and an adhesive or sealant such as a silicone or polyurethane caulk that will remain flexible is used to seal all joints and provide a substantially air tight enclosure.

In accordance with a further aspect, the present invention provides a method of designing a sealed loudspeaker for the home and audiophile markets, the method comprising the steps of: (a) determining a list of required characteristics which form the basis for a high fidelity driver; (b) calculating a preferred value for each of the characteristics in step (a); (c) matching the preferred value characteristics with a bass professional sound reinforcement driver selected from a list of professional sound reinforcement drivers; (d) determining a midrange frequency response of the matched bass driver from step (c), the mid-range frequency response is used to analyse the mid/high frequency performance of the bass driver to; define an estimated breakup frequency, a usable upper frequency, and a driver beaming frequency of the bass driver; (e) calculating an appropriate crossover network filter for at least a 2-way loudspeaker; (f) selecting an appropriate high frequency professional sound reinforcement driver to match the bass driver selected in step (c) and the crossover network calculated in step (e); and (g) designing an enclosure which has a volume of less than 300 Liters to house the bass, mid and high frequency professional sound reinforcement drivers sized for the home and audiophile markets, and wherein the bass driver has a compliance volume in the range of 140 to 1800 Liters, a system compliance ratio ($\alpha$) less than 7.0, and a reference efficiency greater than 1.5% for a total system quality of between 0.5 and 1.0.

Preferably, the matched bass driver selected in step (c) may have a driver diameter of between 15 inches to 21 inches. The designed enclosure in step (g) may have a volume of less than 250 Liters and the total system quality of 0.707.

Alternatively, step (e) may further comprise calculating an appropriate crossover network filter for a 3-way loudspeaker. The 3-way loudspeaker, step (f) may further comprise selecting an appropriate midrange professional sound reinforcement driver to match the bass driver selected in step (c) and the crossover network calculated in step (e).

Preferably, the required characteristics of step (a) may be experimentally determined through an audio testing setup to determine for the sealed enclosure loudspeaker: (i) a driver free air resonant frequency; and (ii) a minimum usable total driver quality.

Preferably, the experimentally determined characteristics may be further refined by calculating a practical driver or total driver quality for a set desirable sealed cut-off frequency or resonant frequency of 50 Hz or less for an enclosure total quality of the system of between 0.5 and 1.0.

Preferably, a compliance volume may be determined to fulfil the desirable sealed cut-off frequency of 50 Hz while limiting an enclosure volume to 250 Liters.

Preferably, the method may further comprise calculating a reference efficiency of the driver using: (i) the compliance volume; and (ii) the total driver quality as an approximate electrical Q factor.

Preferably, the professional sound reinforcement driver may be further limited to any driver that has a free air resonant frequency of less than 40 Hz, to achieve an efficiency of greater than 1.5% with a flat response to the desired target frequency of 50 Hz in a sealed enclosure limited to a volume of no greater than 250 Liters.

Preferably, a driver maximum compliance volume and a driver minimum compliance volume may be calculated to meet the efficiency of greater than 1.5%.

Preferably, a table of usable selection characteristics may be produced from the process steps of the further aspect for the selection of the professional sound reinforcement bass driver that will provide a 70 Hz or below cut-off frequency in a sealed enclosure of less than 3400 Liters with a total quality of the system of between 0.5 and 1.0.

Preferably, designing the enclosure in step (g) may comprise a cabinet housing the professional sound reinforcement bass and high frequency drivers designed to project sound from the cabinet while leaving a space inside the cabinet that is unoccupied by the professional sound reinforcement bass and high frequency drivers, the cabinet and the professional sound reinforcement drivers forming a sealed enclosure.

Preferably, designing the enclosure in step (g) may further comprise adding a damping material mounted in the space inside the cabinet to minimise internal resonances.

Preferably, designing the enclosure in step (g) may further comprise forming the cabinet in any shape.

Alternatively, designing the enclosure in step (g) may further comprise forming the cabinet in a rectangular box shape and bevelling at least one edge on a front surface of the cabinet to reduce baffle diffraction effects.

Preferably, designing the enclosure in step (g) may further comprise providing internal bracing to minimise the amplitude of vibration when exposed to a time varying internal pressure, and wherein the bass driver acts as a bracing strut in the internal bracing.

In accordance with a still further aspect, the present invention provides a method of designing a professional sound reinforcement driver for a sealed loudspeaker for the home and audiophile markets, the method comprising the steps of: (a) determining a list of required characteristics which form a basis for a high fidelity driver; (b) calculating a preferred value for each of the characteristics in step (a); (c) matching the preferred value characteristics with a professional sound reinforcement driver selected from a list of professional sound reinforcement drivers; (d) determining a midrange frequency response for the matched selected driver from step (c) the mid-range frequency response is used to analyse the mid/high frequency performance of the selected driver to; define an estimated breakup frequency, a usable upper frequency, and a driver beaming frequency of the selected driver; and (e) designing an enclosure which has a volume of less than 300 Liters to house the professional sound reinforcement driver which is suitably sized for the home and audiophile markets and has a compliance volume in the range of 140 to 1800 Liters, or a system compliance ratio ($\alpha$) less than 7.0, and a reference efficiency of greater than 1.5% for a total system quality of between 0.5 and 1.0.

Preferably, the driver may be selected from any one or more of: (i) a bass driver; (ii) a midrange driver; (iii) a high frequency driver; (iv) a coaxial driver; or (v) a subwoofer driver.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

DETAILED DESCRIPTION OF THE INVENTION

Figure 1:
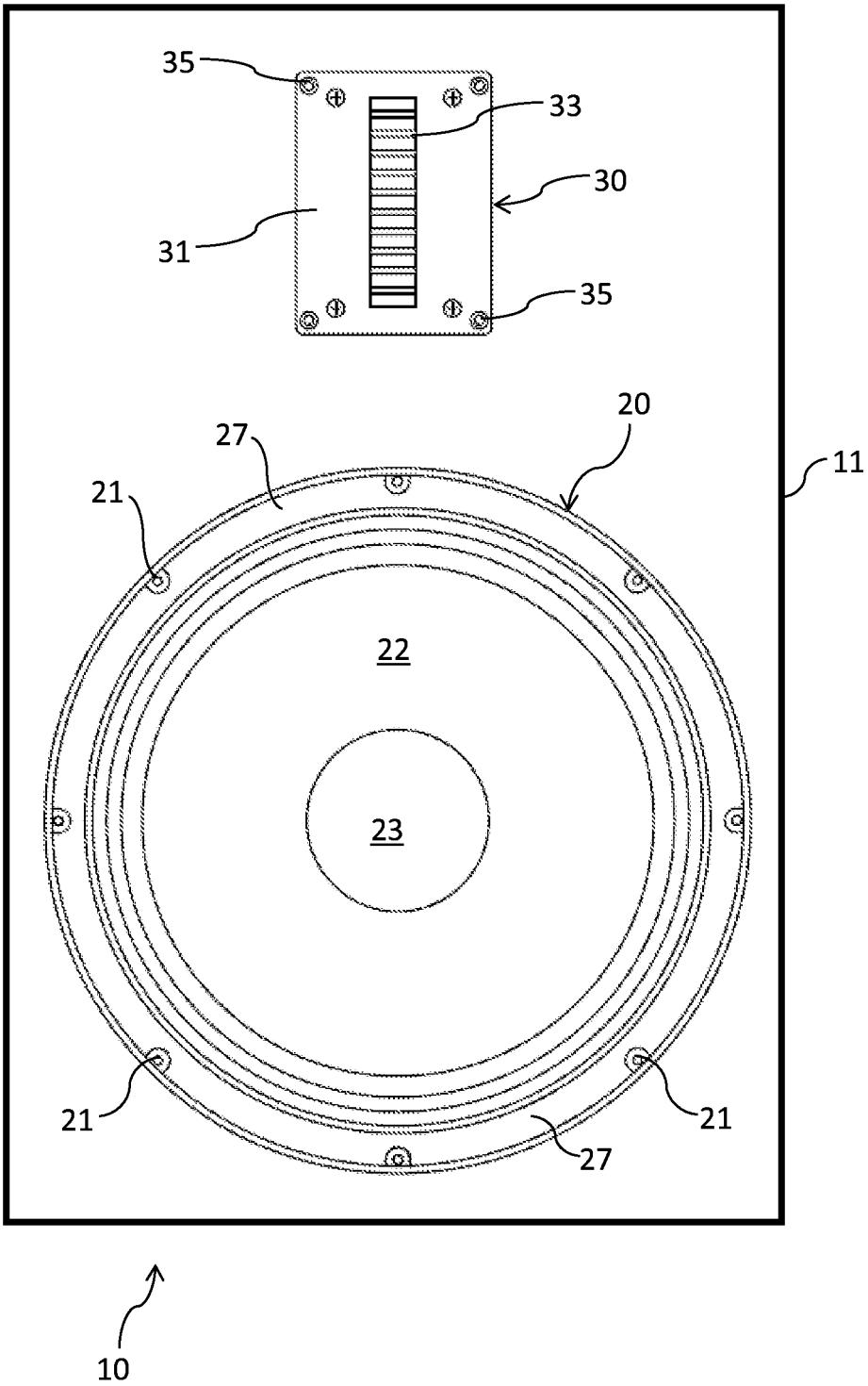
FIG. 1 illustrates a front view of a loudspeaker in accordance with an embodiment of the present invention.

The following description, given by way of example only, is described in order to provide a more precise understanding of the subject matter of a preferred embodiment or embodiments.

The present invention has been devised to overcome a need in the field of high fidelity audio reproduction for sealed loudspeakers 10 using professional sound reinforcement drivers 20, 30, 40, wherein the loudspeaker 10 can be used for the audiophile and home user environment. A high efficiency Hi-Fi loudspeaker design is used to form the basis for a sealed loudspeaker 10 comprising a professional sound reinforcement bass driver 20 determined using the calculated characteristics described below, paired with an appropriately matched professional sound reinforcement tweeter drivers 30 and/or midrange drivers 40. A sealed enclosure prevents sound emitted from the rear of the loudspeaker 10 cancelling with the front by confining the drivers 20, 30, 40 in a rigid and airtight box.

A loudspeaker 10 is an electroacoustic transducer which converts an electrical audio signal into a corresponding sound. What we hear as sound is a class of kinetic energy called acoustical energy and consists of fluctuating waves of pressure in air. This periodic vibration which is audible to the average human is known as the audio frequency spectrum. The accepted standard range of audible frequencies is 20 to 20,000 Hertz (Hz), although this range is greatly influenced by environmental factors and age.

Loudspeakers or speakers 10 are typically housed in an enclosure which is often a rectangular or square box made of wood or sometimes plastic, and the enclosure plays an important role in the quality of the sound. However, the shape of the loudspeaker 10 is not only limited to those shapes and any shaped enclosure or cabinet can be utilised. For example, the enclosure could be any regular or irregular prism shaped three dimensional object.

To adequately reproduce a wide range of frequencies with even coverage, most loudspeaker systems 10 employ more than one driver. Individual drivers are used to reproduce different frequency ranges. The drivers are named subwoofers (for very low frequencies); bass drivers or woofers (low frequencies) 20, mid-range speakers (middle frequencies) 40, tweeters (high frequencies) 30 and coaxial drivers (not shown). The terms for different speaker drivers differ, depending on the application. In two-way systems there is no mid-range driver 40, so the task of reproducing the mid-range sounds falls upon the woofer 20 and tweeter 30 or a coaxial driver. When multiple drivers are used in a system, a "filter network", called a crossover 50, separates the incoming signal into different frequency ranges and routes them to the appropriate driver 20, 30, 40. A loudspeaker system 10 with a three-way system employs a woofer 20, a mid-range 40, and a tweeter 30 or coaxial driver.

A typical sound reinforcement system consists of a number of key components. The present invention is directed primarily to the design of a loudspeaker 10 using a professional sound reinforcement driver which converts the electrical audio signal back into sound energy (the sound heard by the audience and the performers). From a specifications point of view, it has been noted that the bass drivers 20 have a high sensitivity >96 db 1 W/m, a high reference efficiency >1.5%, a low compliance volume (Vas) (generally observed to be at least half of their Hi-Fi equivalents for the same size) and a driver size that is physically large. To further distinguish the differences between Hi-Fi and professional sound reinforcement drivers, Table 1 below shows a comparison of the Thiele/Small parameters for a sample of 12 inch drivers. Table 1A shows a list of the drivers used in the comparison.

TABLE 1

| T/S Parameters | 12" Hi-Fi (Av) | 12" Pro Sound Reinforcement (Av) |
|---|---|---|
| Impedance Nominal | 8 | 8 |
| Nominal Power Rating | 173 | 406 |
| Program Power Rating | 333 | 738 |
| Sensitivity (dB 1 W/1 m) | 89 | 99 |
| Fs | 24 | 50 |
| Re | 6.2 | 5.5 |
| Qms | 5.6 | 6.2 |
| Qes | 0.43 | 0.30 |
| Qts | 0.39 | 0.29 |
| Vas | 163.3 | 76.4 |
| Mms | 107.8 | 53.8 |
| BL | 15.2 | 17.8 |
| Le | 1.4 | 1.2 |
| Xmax | 9 | 5.3 |
| Ref. Efficiency (η0) | 0.5% | 3.3% |

TABLE 1A

| Hi-Fi Drivers | Sound Reinforcement Drivers |
|---|---|
| Peerless NE315W-08 | Beyma 12G40 |
| Peerless SLS-P830669 | Beyma 12MC500 |
| Peerless XXLS-P830845 | Beyma 12WR400 |
| Dayton Audio DC300-8 | B&C 12CL64 |
| Dayton Audio DS315-8 | B&C 12FW64 |
| Dayton Audio RSS315HFA-8 | B&C 12NDL66 |
| SB Acoustics SB34NRXL75-8 | 18 Sound 12MB1000 |
| MONACOR SPH-300KE | 18 Sound 12W500 |

By way of example only professional sound reinforcement drivers 20, 30, 40 have as a result of their diaphragm surface area and also their efficiency an advantage when compared with standard Hi-Fi drivers. Mathematically this is quite evident from the analysis below. The SPL of a driver operating in its pistonic area of operation mounted on an infinite baffle for a set frequency at a distance of 1 m away is given by Equation 1.

$$SPL_{dB} = 20\log_{10}\left(\frac{S_d * \chi * f^2 * \pi * \rho * \sqrt{2}}{P_0}\right) \quad \text{Equation 1}$$

In Equation 1:

$S_d$=cone surface area in $m^2$;

$\chi$=the cone excursion in meters which we are trying to identify;

f=the output frequency of the driver in Hz;

ρ=the sound density of air at 25° C.=1.1839 $kg/m^3$; and $P_o$=the pressure level for the threshold of hearing=20 μPa.

Table 2 shows the theoretical cone excursion compared to the rated Xmax of the driver to achieve an SPL of 100 dB @1 m distance for a number of example driver sizes. The frequency used in the calculation is Fb(ζ)=50 Hz.

TABLE 2

| Example Driver | Diameter (Inch) | Driver Type | Target Freq. (Hz) |
|---|---|---|---|
| Beyma 18LX60V2 | 18 | PA | 50 Hz |
| RCF LF21X451 | 21 | PA | 50 Hz |
| SEAS H1085-08 L18RCY/P | 6.5 | Hi-Fi | 50 Hz |
| Peerless SBS-250F38CP01-04 | 10 | Hi-Fi | 50 Hz |

| Example Driver | Target SPL@1 m (dB) | Req. Excursion (mm) |
|---|---|---|
| Beyma 18LX60V2 | 100 dB | 1.15 |
| RCF LF21X451 | 100 dB | 0.9 |
| SEAS H1085-08 L18RCY/P | 100 dB | 12.2 |
| Peerless SBS-250F38CP01-04 | 100 dB | 4.5 |

| Example Driver | Cone Area ($m^2$) | Driver Xmax Excursion Limit (mm) |
|---|---|---|
| Beyma 18LX60V2 | 0.1320 | 9 |
| RCF LF21X451 | 0.1730 | 13.5 |
| SEAS H1085-08 L18RCY/P | 0.0125 | 4 |
| Peerless SBS-250F38CP01-04 | 0.0340 | 10.5 |

From Table 2 we note that for the target frequency of 50 Hz at an SPL of 100 dB, the calculated excursion of the professional sound reinforcement drivers is considerably smaller than the Hi-Fi drivers. The next aspect to look at is how much power is required for each of these drivers to reach the 100 dB threshold for an enclosure designed to have an F3 (−3 dB) frequency of 50 Hz. For analysis purposes power compression is ignored.

The power gain in dB based on the input power level is given by Equation 2.

$$SPL_{dB\,GAIN} = 10\log_{10}\left(\frac{P_{AMPLIFIER}}{P_{1W}}\right) \quad \text{Equation 2}$$

TABLE 3

| Driver | Diameter (Inch) | Reference Efficiency |
|---|---|---|
| Beyma 18LX60V2 | 18 Inch | 1.91% 95 dB 1 W/m |
| RCF LF21X451 | 21 Inch | 2% 95.1 dB 1 W/m |
| SEAS H1085-08 L18RCY/P | 6.5 Inch | 0.35% 87.5 dB 1 W/m |
| Peerless SBS-250F38CP01-04 | 10 Inch | 0.23% 85.7 dB 1 W/m |
| **Driver** | **Target Frequency (Hz)** | **1 W SPL@F3 = 50 Hz** |
| Beyma 18LX60V2 | 50 Hz | 92 dB |
| RCF LF21X451 | 50 Hz | 92.1 dB |
| SEAS H1085-08 L18RCY/P | 50 Hz | 84.5 dB |
| Peerless SBS-250F38CP01-04 | 50 Hz | 82.7 dB |
| **Driver** | **Req. Excursion (mm)** | **Amp Power Req. @ SPL = 100 dB 1 m** |
| Beyma 18LX60V2 | 1.15 | 7 W |
| RCF LF21X451 | 0.9 | 6 W |
| SEAS H1085-08 L18RCY/P | 12.2 | 36 W |
| Peerless SBS-250F38CP01-04 | 4.5 | 54 W |

Table 3 illustrates the differences in the amount of power required for each of the professional sound reinforcement drivers and the Hi-Fi drivers to reach the 100 dB threshold for an enclosure designed to have an F3 (−3 dB) frequency of 50 Hz. The amount of power required to drive the PA drivers (Beyma 18LX60V2 and RCF LF21X451) is considerably less than the Hi-Fi counterparts. Likewise the reference efficiency of the PA drivers is greater than 1.5%.

Professional sound reinforcement drivers designed for low frequency bass reproduction to the lowest octave of the audible spectrum, are 15, 18 and 21 inches in diameter and almost always employ a surround that is of the accordion type giving rigidity. These drivers also have a large power handling and lower compliance suspension system (in comparison to Hi Fi speakers) with the resonant frequency (Fs) of the driver being higher as a compromise. Professional sound reinforcement drivers used for the reproduction of mid and high frequencies e.g. line arrays often have sensitivities greater than 98 dB 1 W/m. These are based on compression drivers, piezo, horn loaded and pleated diaphragm tweeters (Air Motion Transformers).

These drivers are also desirable, in that professional sound reinforcement drivers have subtle tone characteristics that are desired by live performers, which make them difficult to quantify and which conventional Hi-Fi loudspeaker systems struggle to reproduce. The downside in almost all cases is a very large enclosure and is a key challenge to be solved in this design.

Figure 2:
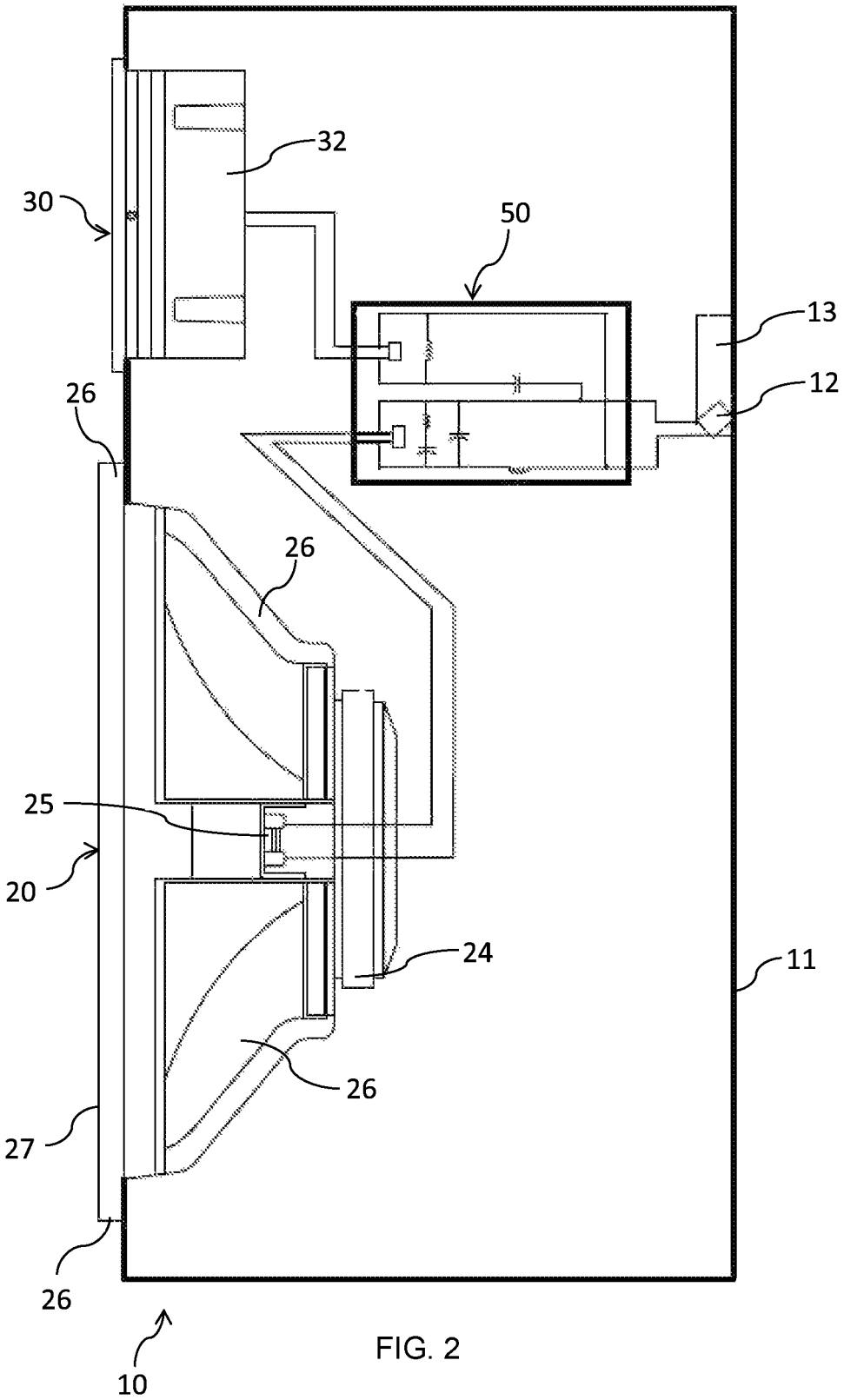
FIG. 2 shows a sectional side view of the loudspeaker of FIG. 1.

As shown in FIGS. 1 and 2, the present invention is a sealed loudspeaker 10 designed for the home and audiophile markets. The loudspeaker 10 has at least one professional sound reinforcement driver 20, 30, 40. FIG. 1 shows a two-way design with a bass driver 20 and a tweeter driver 30, and a crossover network 50 mounted inside the sealed enclosure 11. The cabinet or case 11 has located on the rear surface a speaker box terminal cup 13 with the binding post terminals 12 for connecting the loudspeaker 10 to an amplifier (not shown).

In accordance with the present invention the sealed enclosure has an enclosure volume of less than 300 liters. The limiting of the enclosure volume ensures that the physical size of the loudspeaker 10 is appropriate for the audiophile and home user environment. The professional sound reinforcement bass driver 20 utilised in the loudspeaker 10 has a small compliance volume (Vas) or a large system compliance ratio (α) for a total system quality of between 0.5 and 1.0. Through design and experimentation the professional sound reinforcement driver which will meet the above criteria has a bass driver diameter of between 15 inches to 21 inches. The bass driver 20 has a 70 Hz or below cut-off frequency in a sealed enclosure with a total quality of the system (Qtc) of between 0.5 and 1.0. As is further illustrated in Table 22 for a target frequency of 50 Hz the professional sound reinforcement bass driver 20 has a compliance volume in the range of 140 to 1800 liters, a system compliance ratio (α) less than 7.0, and a reference efficiency of greater than 1.5% in a sealed enclosure with a volume of less than 300 liters with a total quality of the system (Qtc) of between 0.5 and 1.0.

The sealed enclosure illustrated has an enclosure volume of less than 250 liters. The limiting of the enclosure volume ensures that the physical size of the loudspeaker 10 is appropriate for the audiophile and home user environment. The professional sound reinforcement bass driver 20 utilised in the loudspeaker 10 has a small compliance volume (Vas) or a large system compliance ratio (α) for a total system quality of between 0.5 and 1.0.

To produce low frequencies a driver needs to have a large diaphragm and enough mass to resonate at a low frequency. The most common design for the bass driver 20 is the electrodynamic driver, which typically uses a stiff paper cone 22, driven by a voice coil (not shown) surrounded by a magnet 24 producing a magnetic field. The voice coil is attached by adhesives to the back of the speaker cone 22 and a dust cap 23 covers the front of the voice coil. The voice coil and the magnet 24 form a linear electric motor. When current flows through the voice coil, the coil moves in relation to the frame 26, causing the coil to push or pull on the driver cone 22 in a piston-like way. The resulting motion of the cone 22 creates sound waves, as it moves in and out. Terminals 25 attached to the rear side of the frame 26 allow the current to flow from the low pass filter 54 of the crossover network 50 to the voice coil. A variety of terminal types can be used, including simple push-on terminals 25 as shown or alternatively gold-plated binding posts.

The bass driver 20 has a number of mounting holes 21 equally spaced around the circumference of the mounting flange 28, the mounting holes 21 allow for the mounting of the bass driver 20 to the cabinet 11. A frame 26 provides a rigid structure to which the driver components are mounted. A gasket 27 ensures a smooth and flat mounting surface so that the bass driver 20 has an airtight seal to the box or cabinet 11. Optionally, since most bass drivers 20 are mounted using the back side of the mounting flange 28, a rear (optional) gasket is often desired.

Bass driver 20 design requires effectively converting a low frequency amplifier signal to mechanical air movement with high fidelity and acceptable efficiency, and is both assisted and complicated by the necessity of using a loudspeaker enclosure to couple the cone motion to the air. At ordinary sound pressure levels (SPL), most humans can hear down to about 20 Hz. The bass driver 20 covers the lowest octaves of a loudspeaker's frequency range. In the two-way loudspeaker system illustrated in FIGS. 1 and 2, the bass driver 20 handling the lower frequencies are also used to cover a substantial part of the midrange, possibly as high as 3000 Hz.

To produce high frequencies a driver needs to have a small diaphragm with a low mass. In FIGS. 1 and 2 the high frequencies are covered by the tweeter driver 30. The tweeter 30 is designed to produce high audio frequencies, typically from around 2,000 Hz to 20,000 Hz. The tweeter drivers 30 are the smaller drivers since they produce the highest frequencies with the shortest wavelengths. The tweeter driver 30 has a sealed back 32 to stop air movement from the bass driver 20 affecting the output and prevent damage to the tweeter 30. This removes the need for a separate enclosure for the tweeter 30. The tweeter 30 has a front mounting plate 31 with mounting holes 35 for mounting the tweeter driver 30 to the cabinet or case 11. The tweeter driver 30 comes in a number of different configurations which are distinguished by the components, motor topology and the materials used. The tweeter driver 30 could be any one of an electrostatic speaker, a piezo tweeter, a dome or cone tweeter, an air motion transformer (AMT) or a planar ribbon (planar magnetic) tweeter.

By way of example only, an air motion transformer (AMT) tweeter 30 is illustrated in FIGS. 1 and 2. The AMT tweeter 30 uses a folded thin film diaphragm 33 with aluminium conductors that are formed similar to an accordion squeezebox with the diaphragm 33 placed between opposing magnets. When signal current is passed it starts oscillating in the plane of the diaphragm 33 with folds contracting and expanding and thus squeezing air in and out.

FIG. 2 also shows the crossover network 50 and the wiring connections between the binding post terminals 12 and the connection between the drivers 20, 30 and the respective filters 53, 54 of the crossover network 50.

Figure 3:
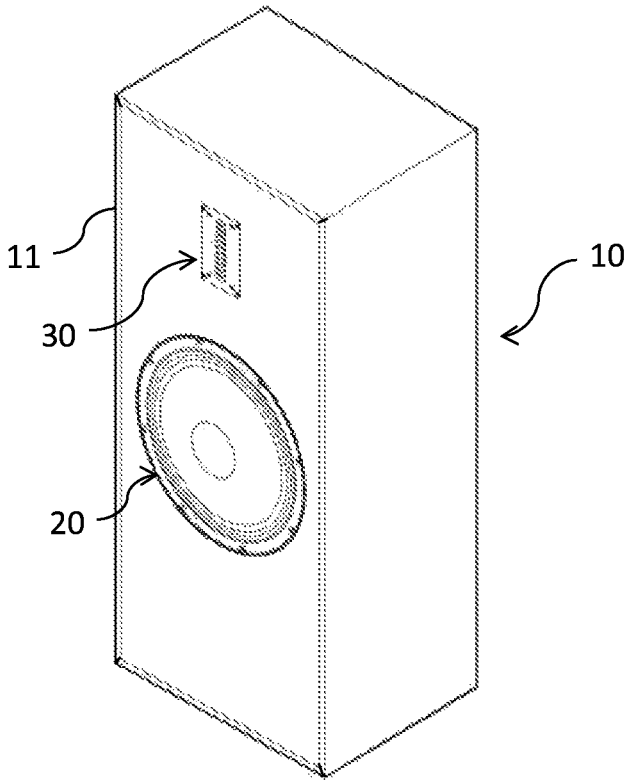
FIG. 3 shows a perspective view of a loudspeaker in accordance with an embodiment of the present invention.

FIG. 3 shows an embodiment of the sealed loudspeaker 10 for a 2-way speaker design with a bass driver 20 and a high frequency or tweeter driver 30. The case or cabinet 11 is a rectangular enclosure. As noted above, the shape of the enclosure is not only limited to a rectangular shape and could be any shape. The role of the enclosure is to prevent sound waves emanating from the back of a driver 20 from interfering destructively with those from the front. The sound waves emitted from the back are 180° out of phase with those emitted forward, so without an enclosure they typically cause cancellations which significantly degrade the level and quality of sound at low frequencies. The sealed enclosure prevents transmission of the sound emitted from the rear of the loudspeaker by confining the sound in a rigid and airtight box. By way of example only, the case 11 is constructed from timber of approximately 18 mm in thickness with a damping material (not shown). The damping material used in this example is a polyester textile fibre or fibre reinforced plastic. The enclosure volume is approximately 220 liters excluding internal bracing (not shown) and driver 20 volume displacement.

One of the limiting effects of a loudspeaker enclosure design is the effect of diffraction. The radius edge provides an enclosure which reduces the magnitude of the diffracted wave, since the wave does not immediately expand into space upon reaching the edge. The benefits of edge rounding come into play only when the radius is greater than ⅛th wavelength. Thus a typical ½ inch radius begins to diffuse the diffracted wave at frequencies above 3.4 kHz, but will decrease in relevance at lower frequencies, when the sound output from driver interacts with the edge due to its increasing directivity.

Figure 4:
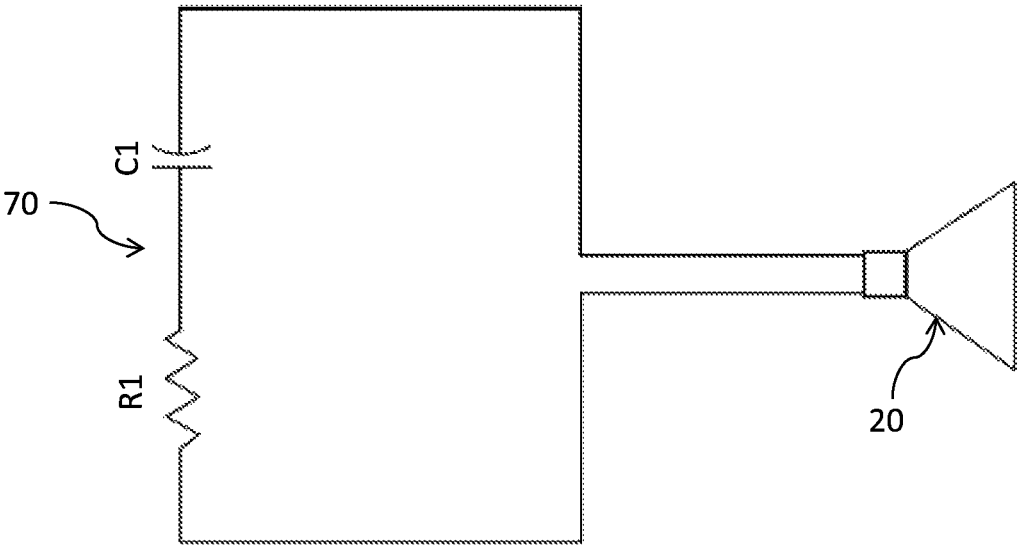
FIG. 4 illustrates a Zobel network connected in parallel with the driver to provide impedance correction for the driver.

FIG. 4 shows a typical Zobel network 70 to linearize the impedance of a bass driver 20. As shown, the Zobel network 70 is a series resistor (R1), capacitor (C1) network that is connected in parallel with the bass driver 20 in order to neutralize the effects of the driver's voice coil inductance. In most designs and as shown in FIG. 5 the Zobel network 70 is mounted on the crossover network 50 circuit board.

Figure 5:
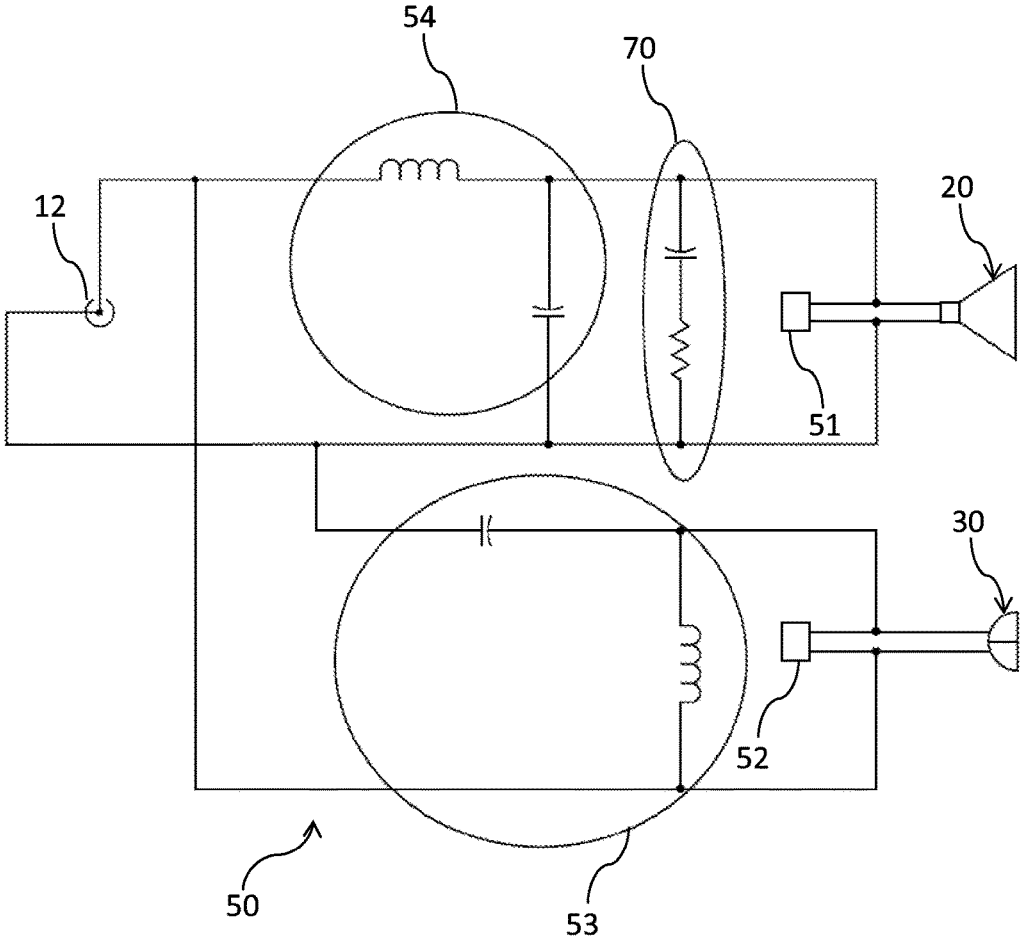
FIG. 5 shows a crossover network schematic for the loudspeaker of FIG. 1.

FIG. 5 illustrates the crossover network 50 for a 2-way loudspeaker design with a bass driver 20 and a tweeter driver 30. The crossover network 50 as illustrated is a parallel crossover network 50 with a low frequency driver connector 51, a high frequency driver connector 52 and an input connection from the binding post terminal 12 all mounted on the crossover network circuit board. As discussed above the Zobel network 70 is connected in parallel with the bass driver 20. A low pass filter 54 is designed to pass signals with a frequency lower than a certain cut-off frequency and attenuates signals with frequencies higher than the cut-off frequency, the low pass filter 54 passes the signals to the bass driver 20. The exact frequency response of the filter depends on the filter design and will be discussed in detail below in relation to the crossover design steps in the process for designing the loudspeaker 10. A high pass filter 53 passes signals with a frequency higher than the cut-off frequency and attenuates signals with frequencies lower than the cut-off frequency, the high pass filter passes signals to the tweeter driver 30. The amount of attenuation for each frequency depends on the filter design and will be discussed in detail below in relation to the crossover design steps in the process for designing the loudspeaker 10.

FIGS. 6 to 10 show a speaker enclosure or cabinet 80 in accordance with an embodiment of the present invention. The loudspeaker enclosure or cabinet 80 consists of a top and bottom panel 81, two side panels 84, a rear wall 88 and a front speaker baffle panel 85. With all panels 81, 84, 88 and 85 joined to form an interior space 82 defining the loudspeaker enclosure or cabinet 80. The rear edge of each panel 81, 84 has a mitred recess 83 which is designed to receive the rear panel 88 therein. The rear wall panel 88 also has an aperture 89 cut into the panel 88 to receive box terminal cup 13.

The speaker baffle 85 forms the front face of the loudspeaker 80 and serves as the mounting surface for the tweeter 30, bass driver 20 and midrange driver 40. The mounting surface of the speaker baffle 85 has as illustrated, two apertures 86, 87 for receiving the bass driver 20 and the tweeter driver 30. Along with holding the drivers 20, 30 in place, the speaker baffle 85 also prevents out of phase air from the back of the drivers 20, 30 cancelling the front air wave and therefore preventing phase cancellation. The speaker baffle 85 also has a rounded or chamfered edge 90, the rounded edge 90 reduces diffraction. The rounded edge 90 of the speaker baffle 85 is a very effective means of controlling cabinet diffraction and smoothing the overall frequency response.

Given that sound is pressure, or more precisely, it is the propagation of pressure waves in air, we need to understand that this pressure is pushing a waveform that is expanding to fill the space around it in a spherical manner. In other words, it is expanding in all directions equally. The acoustic effects of diffraction are always directly related to the ratio of distance versus the wavelength of sound at a given frequency. When a loudspeaker produces a sound, this sound is in the form of a pressure wave trying to expand equally in all directions spherically. The first obstacle that this wave encounters is the baffle face itself before reaching the baffle edge. If the baffle edge is sharp, there is a very sudden change in the propagation of the wave. The sharp corner acts like an obstacle changing the direction of the wave; the wave diffracts and the edge becomes a secondary source, reradiating sound back towards the original wave. The bevelling of the edge reduces the discontinuity in the waveform.

The sealed enclosures 11, 80 described above have been designed so that the professional sound reinforcement drivers 20, 30, 40 are completely housed in a box of an appropriate size to prevent sounds from being radiated from the rear of the drivers, confining the back sound wave within the rigid airtight box 11, 80. Thus, only sound waves radiated from the front side of drivers 20, 30, 40 will reach the listeners. Sealed type enclosures 11, 80 provide accurate low frequency reproduction with good transient response.

In order to absorb the back wave of the speaker and minimise enclosure standing waves, a damping material is placed inside the interior space 82 of the enclosure 11, 80. The damping material is a fibrous material such as fibreglass, bonded acetate fiber (BAF), long-fiber wool, polyester textile fibre, fibre reinforced plastic, glass wool, wool, or synthetic fiber batting that is wrinkle-resistant and strong. However other types of damping material may be used for example, carpet or other like materials provided they absorb the back wave of sound from the drivers 20, 30, 40. The internal shape of the enclosure 11, 80 can also be designed to reduce this by reflecting sounds away from the driver diaphragms, where they may then be absorbed. This includes the use of internal bracing. Internal bracing can be used to reinforce the cabinet walls or for extra support for the speaker baffle. The speaker baffles should be reinforced in particular when the baffle has been weakened by the cut-outs or apertures formed in the baffle for the drivers 20, 30, 40. In the prototype design, the bass driver frame actually forms part of the bracing frame providing even more rigidity to the enclosure. Internal bracing can also be utilised to prevent large, wide walls from flexing.

The enclosures 11, 80 in order to provide the sealed air tight nature require particular attention be paid to the bonding and joining of each side. An appropriate adhesive is required to ensure that each side of the enclosures 11, 80 are strongly joined to each other. The sides of the enclosure and the attachment of the drivers 20, 30, 40 to the baffle 85 require that they be mounted, sealed and screwed in place. By way of example only, the adhesive or sealant is a silicone or polyurethane caulk that will remain flexible, the caulk is used to seal all joints and provide a substantially air tight enclosure.

Other techniques may be used to reduce transmission of sound through the walls of the cabinet 11, 80 and include using thicker cabinet walls, lossy wall material, internal bracing or curved cabinet walls. The cabinet walls and internal bracing are manufactured from a medium-density fibreboard (MDF) or plywood. For example, the cabinet 11, 80 and the internal bracing are manufactured from a mixture of solid timber and birch plywood. Many materials may be used for the cabinet 11, 80 and the internal bracing provides the finished product with walls that are strong such that resonances and cabinet vibrations are reduced as much as possible. An external surface of the cabinet or case 11, 80 is covered with any one or more of a thin decorative covering such as a veneer or a covering finish such as carpet, varnish or paint.

The speaker mounting scheme (including cabinets) can also cause diffraction, resulting in peaks and dips in the frequency response. The problem is usually greatest at higher frequencies, where wavelengths are similar to, or smaller than, cabinet dimensions. The enclosure 11, 80 or driver 20, 30, 40 must have a small leak so internal and external pressures can equalise over time, to compensate for barometric pressure or altitude. Typically, the porous nature of cones and surrounds 22 are normally sufficient to provide this slow pressure equalisation.

A speaker grille or grill (not shown) is usually found in front of the loudspeaker 10, and consists of either a hard or soft screen/grille mounted directly over the face of the professional sound reinforcement drivers 20, 30, 40. It is used to protect the driver elements and speaker internals from foreign objects while still allowing the sound to clearly pass. The speaker grill can be manufactured from acoustic grill cloth, speaker grille clips as well as metal grills and plastic grills.

Figure 11:
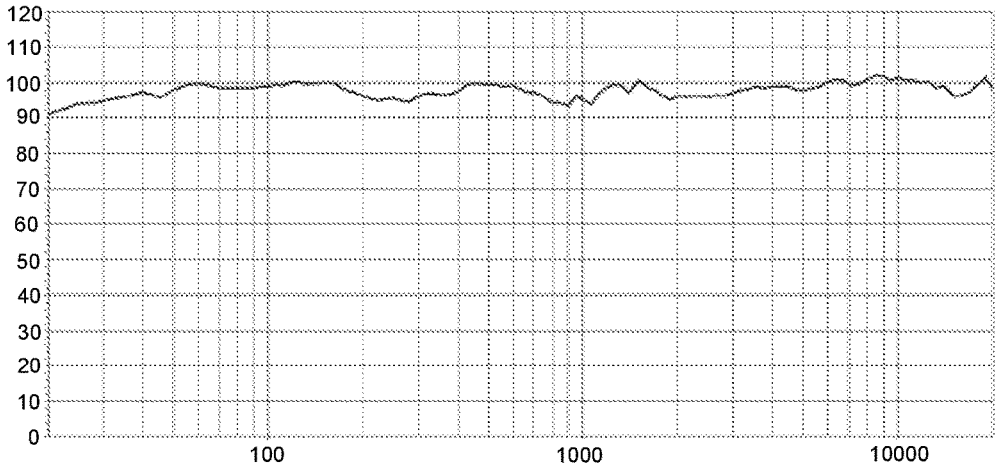
FIG. 11 shows the on-axis frequency response predicted for the loudspeaker of FIG. 1 that reaches the listener's ear in an ideal small room.
Figure 12:
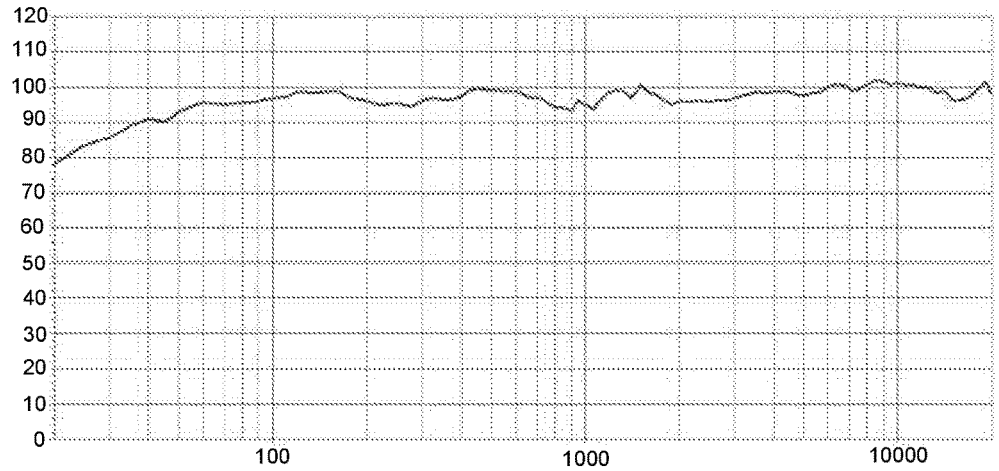
FIG. 12 shows the modelled on-axis frequency response for the loudspeaker of FIG. 1 expected in an anechoic chamber.

FIGS. 11 and 12 show the on-axis frequency response for the loudspeaker 10. FIG. 11 shows the predicted response for the loudspeaker 10 that reaches the listener's ear in an ideal small room. The on-axis frequency response is the response which determines how a loudspeaker sounds. In an on-axis frequency response measurement, the microphone is placed directly in front of the speaker a set distance away. The microphone is at the same vertical height as the speaker, and is facing the speaker directly, not from an angle. The speaker itself is also facing the microphone. This is done with the assumption that when one listens to a given speaker, the speakers will be positioned such that they will be facing the listener directly.

In the absence of an anechoic chamber, the on-axis frequency response measurements are conducted with a 2.83 VRMS (1 W @ 8Ω) excitation signal at a distance determined by proper summing of all drivers in the system. This distance is determined by successively conducting a windowed measurement. The windowed measurement is a signal processing technique applied to only use the part of a measured impulse response that contains data before the first reflection of the sound from the nearest surface (usually the ceiling or ground). Calculating the length of the reflection free path and dividing by the speed of sound determines the reflection time. The windowed measuring technique starts at 3 times the largest dimension of the source and decreases the measurement distance in steps until one step before response deviations are apparent. The SPL response for all measurements is then scaled to 1 meter mathematically.

FIG. 12 shows the modelled on-axis frequency response for the loudspeaker 10 as if it was measured in an anechoic chamber. One of the most useful places to conduct loudspeaker measurements is an anechoic chamber. Anechoic chambers are large rooms with very thick sound absorption material on all surfaces and offer a good estimation of free-space measurements down to a cut-off frequency specific to the chamber. Anechoic chambers can be calibrated to measure loudspeakers to frequencies below the cut-off frequency allowing full acoustic spectrum measurements. As above for FIG. 11, the graph shown in FIG. 12 shows the resulting SPL in dB mapped over the frequency range for the loudspeaker 10 in an anechoic chamber.

Figure 14:
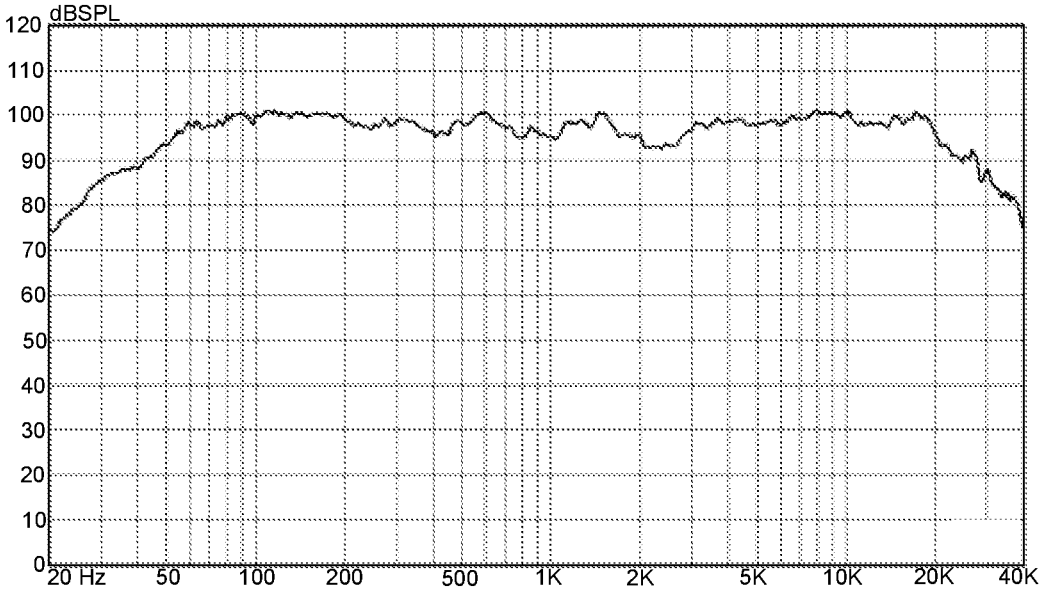
FIG. 14 shows the actual half space ground plane measured on-axis frequency response for the built prototype of FIG. 3.

Alternatively a ground plane also with windowing and near field for low frequencies (half space) measurement techniques can be used. This type of measurement is performed by placing the speaker onto a hard reflective surface and the microphone on the ground and the measurement is taken with unwanted data windowed out. The graph shown in FIG. 14 shows the resulting SPL in dB mapped over the frequency range for a half space ground plane measured on-axis frequency response for the loudspeaker 10.

Figure 17:
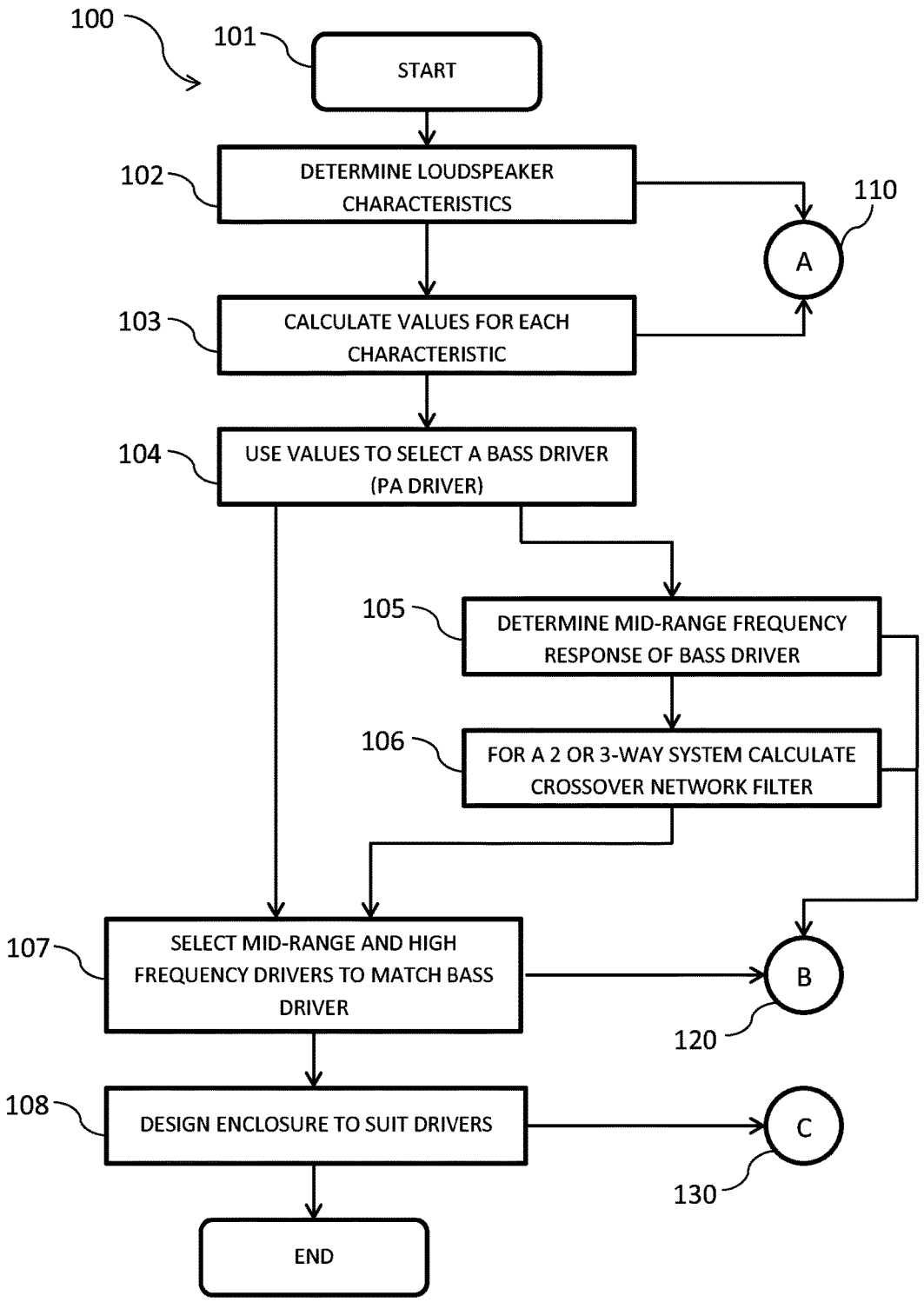
FIG. 17 shows a flowchart of the design process or steps in producing the loudspeaker FIG. 1.

FIGS. 17 to 20 illustrate the method or process 100 for designing a sealed loudspeaker 10 for the home and audiophile markets. The process can also be adapted to the design of a professional sound reinforcement driver for the loudspeaker 10. In it broadest form as illustrated in FIG. 17 the process 100 includes the steps of starting the process at step 101 by performing thorough experimentation tests using a microphone and signal generator to determine 102 the required characteristics which form the basis for a high fidelity driver. Step 103 shows the calculated values for each of the Thiele/Small parameters or characteristics. It is to be noted that all calculations and measurements are based on a half space radiation pattern where the system is only radiating in the forward hemisphere. Baffle step loss, where low frequencies can radiate omnidirectionally, are not discussed in the design methodology. The baffle step loss is highly dependent on baffle size and the listening environment. In the case of a large diameter low frequency driver, the front baffle size is quite large and the baffle step loss transition occurs at a low frequency. The baffle step loss is also highly dependent on the application being used. In a domestic environment, speakers are generally used within a reasonable proximity to a rear wall or potentially mounted against/recessed into a wall, reducing the measureable baffle step loss considerably. Baffle step correction circuitry can be incorporated into crossover or amplifier designs when the intended application does not get reinforcement from rear boundaries.

To obtain a low frequency cut-off, high efficiency, good transient response and an enclosure design usable in the home environment, the following professional sound reinforcement driver characteristics have been determined 102, 112 as a first pass baseline for sealed enclosure loudspeaker systems 10 and are summarised in Table 4 below.

TABLE 4

| Fs (Free air Resonance Frequency) | 20 Hz | 25 Hz | 30 Hz | 35 Hz | 10 Hz | 45 Hz |
|---|---|---|---|---|---|---|
| Minimum Usable Qts | 0.22 | 0.28 | 0.33 | 0.39 | 0.44 | 0.5 |

In order to meet the requirements determined Table 4 above, professional sound reinforcement drivers have been identified that range in size from between 15 to 21 inches in diameter. Sealed enclosures have an optimally flat response and the lowest −3 dB cut-off frequency (F3) when the enclosure total quality of the system is equal to 0.707 (Qtc=0.707). A Qtc of 0.707 also provides good transient response. At a Qtc of 0.707 the F3 is equal to the resonant frequency (Fb) (resonant frequency and cut-off frequency of the enclosure driver pair in the sealed enclosure). The following steps and FIG. 18 and step 110 will show the calculation 103 of the values for each of the identified important Thiele/Small (T/S) parameters 111 for the selection of the professional sound reinforcement bass driver 20.

T/S commonly refers to a set of electromechanical parameters that define the specified low frequency performance of a loudspeaker driver. These parameters are published in specification sheets by driver manufacturers so that designers have a guide in selecting off-the-shelf drivers for loudspeaker designs. Using these parameters, a loudspeaker designer may simulate the position, velocity and acceleration of the diaphragm, the input impedance and the sound output of a system comprising a loudspeaker and enclosure. Many of the parameters are strictly defined only at the resonant frequency, but the approach is generally applicable in the frequency range where the diaphragm motion is largely pistonic, i.e. when the entire cone moves in and out as a unit without cone breakup.

Figure 18:
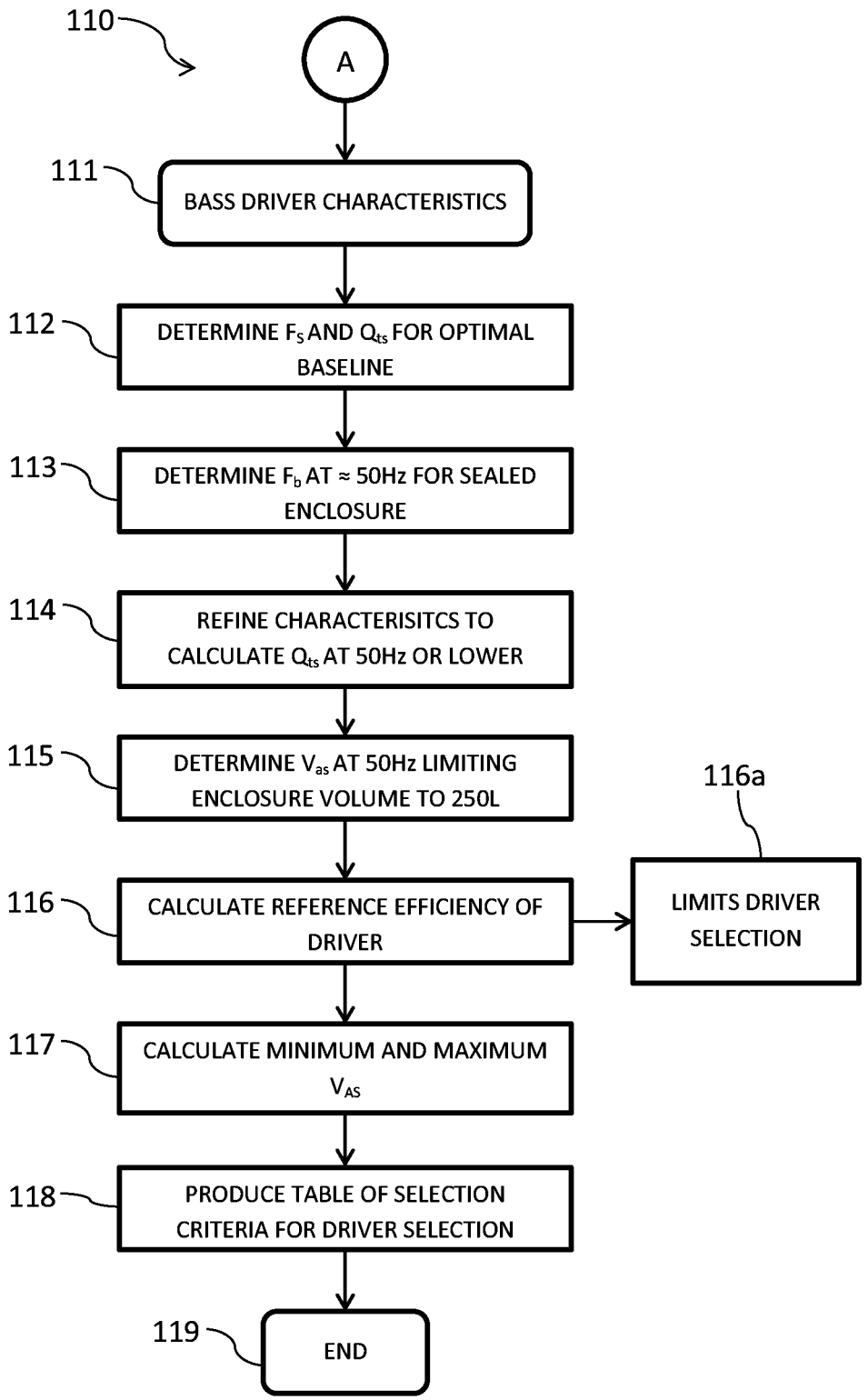
FIG. 18 shows the process A steps for determining the characteristics required for a bass driver for a loudspeaker in accordance with an embodiment of the present invention.

FIG. 18 shows the steps for determining the bass driver characteristics 111. To achieve a flat frequency response with a roll off of −10 dB or less at 30 Hz requires an Fb of approximately 50 Hz or lower in a sealed enclosure of Qtc 0.707. The driver resonant frequency in a sealed enclosure (Fb) is a function of the driver total quality (Qts) and enclosure Qtc. The cut-off frequency at (Qtc 0.707) is given by Equation 3:

$$Fb = F3 = \frac{Qtc * Fs}{Qts} \qquad \text{Equation 3}$$

To achieve this, Table 5 below redefines the characteristics of Table 4 and provides a practical driver Qts for a 50 Hz cut-off frequency. The table shows the comparison between Qts, Fs and Fb=50 Hz with an enclosure Qtc=0.707 as shown at step 113 of FIG. 10. Note for an enclosure to have a Qtc of 0.707, the driver cannot have a Qts>=0.707. The measurements in Table 5 show the bass driver Qts required to give a driver resonant frequency and half space cut-off frequency F3 equal to 50 Hz at different driver resonant frequencies.

TABLE 5

| Fs (Free air Resonance Frequency) | 20 Hz | 25 Hz | 30 Hz | 35 Hz | 40 Hz | 45 Hz |
|---|---|---|---|---|---|---|
| Fb, F3 at Qtc = 0.707 | 50 Hz | 50 Hz | 50 Hz | 50 Hz | 50 Hz | 50 Hz |
| Required Driver Qts | 0.28 | 0.35 | 0.42 | 0.49 | 0.57 | 0.64 |

It is important to note in Table 5 above that the Fs and Qts characteristics of the bass driver are desirable for this application and it is not expected that many of the available drivers will have these characteristics. To achieve an Fb less than 50 Hz in a sealed enclosure with Qtc equal to 0.707 is difficult, as it would require even higher minimum Qts values for the same resonant frequencies. For example, a flat response sealed enclosure Qtc of 0.707 with a desired Fb of 40 Hz would require a driver with Fs of 35, 30 and 25 Hz to need relatively speaking, high Qts values of 0.62, 0.53 and 0.44 respectively. Therefore in order to calculate the Qts at 50 Hz or lower we need to refine the characteristics as shown in step 114 as follows.

From this we can summarise the data mathematically in Table 4 to be able to calculate a Qts value based on the Fs for a given cut-off frequency. To make analysis easier, let's set a baseline sealed frequency threshold of 50 Hz and call this Spero's Sealed Frequency Target=Fb(ζ)=50 Hz as a target Fb desired sealed cut-off frequency, Fs is the driver free air resonance frequency and Qts is the total driver Q. The formula assumes a system Qtc equal to 0.707 the best case scenario, and applicable to drivers of Qts<0.707. The detailed reasoning for selecting Fb(ζ)=50 Hz will be explained in more detail in the next section.

$$\frac{2Fb(\varsigma)}{\sqrt{2}} = \frac{Fs}{Qts} \qquad \text{Equation 4}$$

$$Fb(\varsigma) = \frac{Fs}{\sqrt{2} * Qts} \qquad \text{Equation 4a}$$

Thus Table 5 can be expanded to include all Fs and Qts values that will achieve an Fb(ζ) equal to 50 Hz. Table 6 below shows the expanded parameters identified in Table 5 calculated using the Equation 4a above.

TABLE 6

| Fs | 18 | 19 | 20 | 21 | 22 | 23 | 24 | 25 | 26 | 27 |
|---|---|---|---|---|---|---|---|---|---|---|
| Fb(ζ) | 50 | 50 | 50 | 50 | 50 | 50 | 50 | 50 | 50 | 50 |
| Driver Qts | 0.25 | 0.27 | 0.28 | 0.30 | 0.31 | 0.33 | 0.34 | 0.35 | 0.37 | 0.38 |
| Fs | 28 | 29 | 30 | 31 | 32 | 33 | 34 | 35 | 36 | 37 |
| Fb(ζ) | 50 | 50 | 50 | 50 | 50 | 50 | 50 | 50 | 50 | 50 |
| Driver Qts | 0.40 | 0.41 | 0.42 | 0.44 | 0.45 | 0.47 | 0.48 | 0.49 | 0.51 | 0.52 |
| Fs | 38 | 39 | 40 | 41 | 42 | 43 | 44 | 45 | 46 | 47 |
| Fb(ζ) | 50 | 50 | 50 | 50 | 50 | 50 | 50 | 50 | 50 | 50 |
| Driver Qts | 0.54 | 0.55 | 0.57 | 0.58 | 0.59 | 0.61 | 0.62 | 0.64 | 0.65 | 0.66 |
| Fs | 48 | 49 | 50 | | | | | | | |
| Fb(ζ) | 50 | 50 | 50 | | | | | | | |
| Driver Qts | 0.68 | 0.69 | 0.70 | | | | | | | |

Equation 4a can be used for any desired minimum sealed cut-off frequency by replacing Fb(ζ) with Fb and setting Fb to any desired frequency. However, 50 Hz was chosen due to both the difficulty in finding drivers with sufficient Qts to give practical lower Fb frequencies and secondly due to the desire to tie in loudspeaker low frequency roll off with typical listening room gains to achieve a flat response.

Before looking at the next aspect of driver selection, it is important to consider listening room gain. This in fact was one of the determining factors in selecting the Spero Sealed Target Frequency of 50 Hz discussed earlier. A typical home listening room is very different to the anechoic environment that loudspeaker specifications are determined.

An anechoic system is designed to almost eliminate all resonances and reverberations such that the measurements obtained, are solely from the output of the driver under test. A listening room scenario has numerous resonant modes and this in fact can be used to an advantage. Consider the scenario of a listening room in a home environment of 36 square meters (6 m×6 m) and a standard ceiling height. In this instance the frequency that has the same wavelength of 6 m can be determined from Equation 5.

$$C=f*\lambda. \qquad \text{Equation 5}$$

In this instance the speed of sound in air (C) equals 346 m/s at 25 degrees Celsius and wavelength (λ) equals 6 m. Thus from the formula the frequency (f) equals 58 Hz. Therefore a listening room of 6 m×6 m will result in any frequency less than 58 Hz not completing a full cycle before reflecting off a surrounding wall. There are a number of models that have been used to estimate room gain for a loudspeaker and all make varying assumptions about the sound absorption/reflections of the fittings, fixtures, room treatments and materials found in the room, room sizes and ceiling heights. As an example, referenced to 0 dB Table 7 shows a modelled room gain, the frequency response of a loudspeaker expected in an anechoic environment with a target Fb of 50 Hz and the corrected response with the addition of the room gain model.

Looking at the result above, it can be seen how a low frequency response quoted to have a cut-off frequency of 50 Hz (−3 dB) in an anechoic scenario now has an in-room cut-off frequency less than 30 Hz (−2 dB) giving additional credence to the selection of a 50 Hz cut-off frequency F(ζ). Very little music and program material is recorded below 30 Hz and even so, the model above still shows that at 20 Hz we still have useful output (−6 dB) when factoring in room gain.

The next stage of the bass driver selection is to determine the compliance volume (Vas) at step 115 by considering the enclosure sizing. Enclosure volume is related to the compliance volume Vas of the bass driver 20. To achieve a small enclosure size requires either a small Vas and or a large ratio α for a Qts equal to 0.707. A Qtc to Qts ratio of 1.41 (√2) gives the term of α in the formula below a value of 1 and the box volume equals the driver Vas. In a sealed alignment of Qtc=0.707, the box volume (Vb) is given by Equation 6a.

$$Vb = \frac{Vas}{\alpha} \qquad \text{Equation 6a}$$

$$\alpha = \left(\frac{0.707}{Qts}\right)^2 - 1 \qquad \text{Equation 6b}$$

Looking at this closely and as further shown in Equation 6b, driver selection of professional sound reinforcement drivers is limited further as a large Qts approaching Qtc of 0.707 decreases α causing the required enclosure size to increase by orders of magnitude above the Vas. This is ok if the Vas is very small but small Vas drivers have higher Fs values and thus impractical to meet the target Fb(ζ). If we take the example of limiting the box volume to 250 L and use the driver Qts values given in Table 5, we obtain the following Vas limits in Table 8. The calculations obtained in Table 8 show the driver compliance volume Vas requirements to fulfil the cut-off frequency requirements from Table 5 and limiting the maximum enclosure volume to 250 L.

TABLE 7

| Frequency (Hz) | 20 | 30 | 40 | 50 | 60 | 70 | 80 | 90 | 100 | 110 | 120 |
|---|---|---|---|---|---|---|---|---|---|---|---|
| Anechoic Driver (dB) | −16 | −10 | −5 | −3 | −2 | −1 | −0.75 | −0.5 | −0.25 | 0 | 0 |
| Room Gain (dB) | 10 | 8 | 6 | 5 | 4 | 3 | 2.5 | 2 | 1.25 | 1 | 0.8 |
| Corrected Response (dB) | −6 | −2 | 1 | 2 | 2 | 2 | 1.75 | 1.5 | 1 | 1 | 0.8 |

TABLE 8

| Fs (Free air Resonance Frequency) | 20 Hz | 25 Hz | 30 Hz | 35 Hz | 40 Hz | 45 Hz |
|---|---|---|---|---|---|---|
| Fb(ζ), Fb, F3 at Qtc = 0.707 | 50 Hz | 50 Hz | 50 Hz | 50 Hz | 50 Hz | 50 Hz |
| Required Driver Qts | 0.28 | 0.35 | 0.42 | 0.49 | 0.57 | 0.64 |
| Max Box Volume Vb (litres) | 250 | 250 | 250 | 250 | 250 | 250 |
| α (alpha) | 5.37 | 3.08 | 1.83 | 1.08 | 0.54 | 0.22 |
| Calculates Driver Vas | 1350 L | 770 L | 460 L | 270 L | 135 L | 55 L |

The next step 116 and 116*a* is to calculate the reference efficiency of the bass driver 20. Reviewing some of the available drivers, some of the Vas values are unlikely to be found in commercially available drivers. In a practical sense, bass drivers for professional sound reinforcement generally have greater than 1.5%=94 dB 1 W/m calculated reference efficiencies and stated sensitivities often 2-6 dB greater which should limit the Vas and Fs options further. We can use this characteristic to refine the available options. The reference efficiency of a driver is given by Equation 7.

$$\eta 0 = \left(\frac{4\pi^2 + Fs^3 + Vas}{c^3 * Qes}\right) \quad \text{Equation 7}$$

In the formula above c is the speed of sound (346 m/s at 25° C.) and to simplify calculations, the electrical quality factor (Qes) of a driver 20 is observed to be close in value to the driver Qts as shown from Equation 8 below. This is not unexpected as the mechanical quality factor (Qms) used in determining the Qts is a large value thus making the Qes the dominant term in calculating the Qts of a driver. Using the Qts values from Table 6 as approximate Qes values and the Vas values from Table 8 above gives the following efficiencies in Table 10. Table 9 compares Qes to Qts and shows the difference in reference efficiency calculations for a sample of drivers to demonstrate the rationale for using the Qts instead of Qes in simplifying the estimation of reference efficiency.

$$Qts = \frac{Qms * Qes}{Qms + Qes} \quad \text{Equation 8}$$

TABLE 9

| Example Driver | Beyma 12P80ND | Peavey Low Rider | JBL 2241H | RCF LF21X451 | Eminence Beta-15A | 18 SOUND 18LW1400 |
|---|---|---|---|---|---|---|
| Qms | 4.25 | 9.07 | 5.70 | 6.90 | 8.10 | 7.20 |
| Qts | 0.16 | 0.43 | 0.40 | 0.37 | 0.58 | 0.29 |
| Qes | 0.17 | 0.45 | 0.43 | 0.39 | 0.63 | 0.31 |
| Qes − Qts | 0.01 | 0.02 | 0.03 | 0.02 | 0.05 | 0.02 |
| η0 (Actual) | 4.5% | 1.5% | 2.9% | 2.0% | 2.1% | 2.7% |
| η0 (Qts − Qes) | 4.8% | 1.5% | 3.1% | 2.2% | 2.3% | 2.9% |

TABLE 10

| Fs (Free air Resonance Frequency) | 20 Hz | 25 Hz | 30 Hz | 35 Hz | 40 Hz | 45 Hz |
|---|---|---|---|---|---|---|
| Fb, F3 at Qtc = 0.707 | 50 Hz | 50 Hz | 50 Hz | 50 Hz | 50 Hz | 50 Hz |
| Required Driver Qts | 0.28 | 0.35 | 0.42 | 0.49 | 0.57 | 0.64 |
| Approximate Driver Qes | 0.28 | 0.35 | 0.42 | 0.49 | 0.57 | 0.64 |
| Box Volume Vb (litres) | 250 | 250 | 250 | 250 | 250 | 250 |
| α (alpha) | 5.37 | 3.08 | 1.83 | 1.08 | 0.54 | 0.22 |
| Calculated Driver Vas | 1350 L | 770 L | 460 L | 270 L | 135 L | 55 L |
| Calculated Reference Efficiency | 3.6% | 3.2% | 2.8% | 2.2% | 1.4% | 0.7% |

The calculated efficiencies shown in the Table 10 further limit the selection further to drivers that have an Fs of less than 40 Hz. Step 116*a* in FIG. 184 the bass driver with Fs higher than this will not have an efficiency of greater than 1.5% and provide a flat response to the target frequency in a sealed enclosure limited to 250 L. Table 11 below shows our shortlisted desired parameters for a sealed enclosure with Qts 0.707, F(ζ) equal to 50 Hz and reference efficiency greater than 1.5% with enclosure volume limited to 250 L. Tables 11 and 12 also show step 117 in which the maximum and minimum compliance volume Vas are both calculated.

TABLE 11

| Fs (Free air Resonance Frequency) | 20 Hz | 25 Hz | 30 Hz | 35 Hz |
|---|---|---|---|---|
| F(ζ) = Fb, F3 at Qtc = 0.707 | 50 Hz | 50 Hz | 50 Hz | 50 Hz |
| Required Driver Qts | 0.28 | 0.35 | 0.42 | 0.49 |
| Approximate Driver Qes | 0.28 | 0.35 | 0.42 | 0.49 |
| Box Volume Vb (litres) | 250 | 250 | 250 | 250 |
| α (alpha) | 5.37 | 3.08 | 1.83 | 1.08 |
| Calculated Driver Max Vas | 1350 L | 770 L | 460 L | 270 L |
| Calculated Reference Efficiency | 3.6% | 3.2% | 2.8% | 2.2% |

We can also use the efficiency formula to calculate the minimum Vas shown in Table 12 that meets the minimum 1.5% reference efficiency limitation. Table 13 combines both Table 11 and Table 12.

TABLE 12

| Fs (Free air Resonance Frequency) | 20 Hz | 25 Hz | 30 Hz | 35 Hz |
|---|---|---|---|---|
| F(ζ) = Fb, F3 at Qtc = 0.707 | 50 Hz | 50 Hz | 50 Hz | 50 Hz |
| Required Driver Qts | 0.28 | 0.35 | 0.42 | 0.49 |
| Approximate Driver Qes | 0.28 | 0.35 | 0.42 | 0.49 |
| Calculated Box Volume Vb (litres) | 100 | 115 | 135 | 170 |
| α (alpha) | 5.37 | 3.08 | 1.83 | 1.08 |

TABLE 12-continued

| | | | | |
|---|---|---|---|---|
| Calculated Driver Minimum Vas | 560 L | 350 L | 250 L | 180 L |
| Calculated Reference Efficiency | 1.5% | 1.5% | 1.5% | 1.5% |

Table 13 and step 118 of FIG. 18 show a compilation of the usable criteria for the selection of the bass driver 20 that will provide a 50 Hz or below cut-off frequency in a sealed loudspeaker 10 with an enclosure volume of less than 250 L and a total quality of the system (Qtc) of 0.707.

TABLE 13

| | | | | |
|---|---|---|---|---|
| Fs (Free air Resonance Frequency) | 20 Hz | 25 Hz | 30 Hz | 35 Hz |
| F(ζ) = Fb, F3 at Qtc = 0.707 | 50 Hz | 50 Hz | 50 Hz | 50 Hz |
| Required Driver Qts | 0.28 | 0.35 | 0.42 | 0.49 |
| Approximate Driver Qes | 0.28 | 0.35 | 0.42 | 0.49 |
| Box Volume Range (L) | 100-250 L | 115-250 L | 135-250 L | 170-250 L |
| A (alpha) | 5.37 | 3.08 | 1.83 | 1.08 |
| Vas Limit Range | 560-1350 L | 360-770 L | 250-460 L | 180-270 L |
| Reference Efficiency Limit Range | 1.5-3.6% | 1.5-3.2% | 1.5-2.8% | 1.5-2.2% |

Step 119 of FIG. 18 ends the bass driver 20 selection characteristic process. The parameters identified in Table 13 will now provide the guidance required for identifying a professional sound reinforcement driver which will meet the above characteristics for a bass driver for the audiophile and home user environment. A review of the bass sound reinforcement drivers available commercially, using the target F(ζ)=50 Hz and T/S parameters filtered using the guidelines discussed. The resultant range of drivers with usable parameters aligned to the criteria in Table 13 is shown in Table 14 and in step 104 of FIG. 17.

TABLE 14

| Loudspeaker Driver Model | Driver Size (In) | Fs (Hz) | Target F(ζ) (Hz) | Actual Fb, F3 (Hz) | Qts | Vas (L) | 0.707 Qtc Box Vol (L) | Reference Efficiency |
|---|---|---|---|---|---|---|---|---|
| Beyma 18LX60V2 | 18 | 35 | 50 | 51 | 0.48 | 237 | 200 | 1.9% |
| Beyma 18WRS600 | 18 | 32 | 50 | 56 | 0.40 | 372 | 175 | 2.7% |
| Beyma 18LEX1600Nd | 18 | 33 | 50 | 54 | 0.43 | 231 | 136 | 1.7% |
| Beyma 18G40 | 18 | 32 | 50 | 55 | 0.41 | 323 | 164 | 2.4% |
| Beyma 18PWB1000Fe | 18 | 30 | 50 | 53 | 0.40 | 317 | 150 | 1.7% |
| BMS 18N862 | 18 | 25 | 50 | 52 | 0.34 | 312 | 100 | 1.5% |
| Peavey Low Rider 18 | 18 | 29 | 50 | 48 | 0.43 | 288 | 170 | 1.5% |
| RCF LF21X451 | 21 | 28 | 50 | 53 | 0.37 | 385 | 145 | 2.0% |
| Beyma 21PW1400Fe | 21 | 30 | 50 | 60 | 0.35 | 402 | 130 | 2.8% |
| 18 Sound 21NLW4000 | 21 | 29 | 50 | 55 | 0.37 | 305 | 115 | 1.9% |

To summarise, the small number of commercially available drivers identified with their characteristics listed in Table 14, provide a possible explanation as to why professional sound reinforcement drivers have not been used in Hi-Fi applications. At the time of writing and after mathematically modelling the hundreds of drivers available against the criteria determined, only ten (10) drivers shown in Table 14 were identified with the potential to meet the system design requirements.

In addition to these ten (10) drivers, a single 15 inch driver was found, however it was found to require an enclosure size of approximately 300 L due to its high Qts and was excluded from Table 14. Perhaps the drivers identified, which are not designed for Hi-Fi applications meet the discussed design criteria in the preceding pages as a side effect of meeting a different design requirement. Nonetheless, this invention captures the methodology for identifying professional sound reinforcement drivers suitable for Hi-Fi applications and also the required characteristics needed to produce new Hi-Fi bass drivers based on PA driver topologies that can be used to build high end Hi-Fi audiophile loudspeaker systems. The majority of the drivers could be used in a system without requiring a subwoofer. As a result, the design criteria discussed also covers the design of standalone sealed subwoofer enclosures for the home environment.

Low frequency driver selection also needs to include driver motor strength. The driver's motor strength is easily represented by the Bl parameter which is the product of the magnet field strength in the voice coil gap and the length of wire in the magnetic field measured in tesla-meters (T m). This is important and to understand this fully, we must understand how the motor strength affects the Q of the driver, which as we know from above, is one of the critical parameters in determining its sealed enclosure suitability. The total Q of the driver, as discussed previously, is dominated by the drivers electrical Q (Qes) and is given by the equation below where Re is the voice coil DC resistance, Mms is the moving mass, Fs is the resonant frequency and Bl is the magnetic field strength product.

$$Qes = \left(\frac{2\pi * Fs * Mms * Re}{(Bl)^2}\right) \quad \text{Equation 9}$$

It can be seen from Equation 9, that a large BI product and hence a strong driver motor will reduce the Qes (and subsequently the Qts) reducing its suitability for a sealed enclosure. Generally speaking, drivers for sealed enclosures have a weaker motor than those drivers designed for horn loaded, vented, passive radiator and bandpass enclosures. Whilst the selection criteria did not specifically target motor strength, by using the Qes and reference efficiency as we did above, we have indirectly achieved the same result we could have achieved by focussing on motor strength.

Moving forward, now that we have identified a list of suitable bass drivers 20 (Table 14), the next step in the process or method 100 for designing a sealed loudspeaker 10 for the home and audiophile markets is to select one bass driver 20 which can be used to produce the loudspeaker 10. This is step 104. Once chosen the next stage is to analyse the selected bass driver 20 to determine the tweeter driver 30 for a 2-way system or both a tweeter driver 30 and midrange driver 40 for a 3-way speaker system.

With the enclosure sizing and bass driver 20 selection now understood, the focus shifts to sound reproduction for the remainder of the audio spectrum. There are a number of means of achieving this ranging from compression drivers, closed back midranges, Air Motion Transformers and horn loaded Piezo's. Before we look at these technologies it is critical to understand what frequency range we are asking the drivers to reproduce. To do this effectively we need to look at the upper frequency response of the identified bass drivers. At step 105 we now determine the mid-range frequency response of the selected bass drivers 20.

Figure 19:
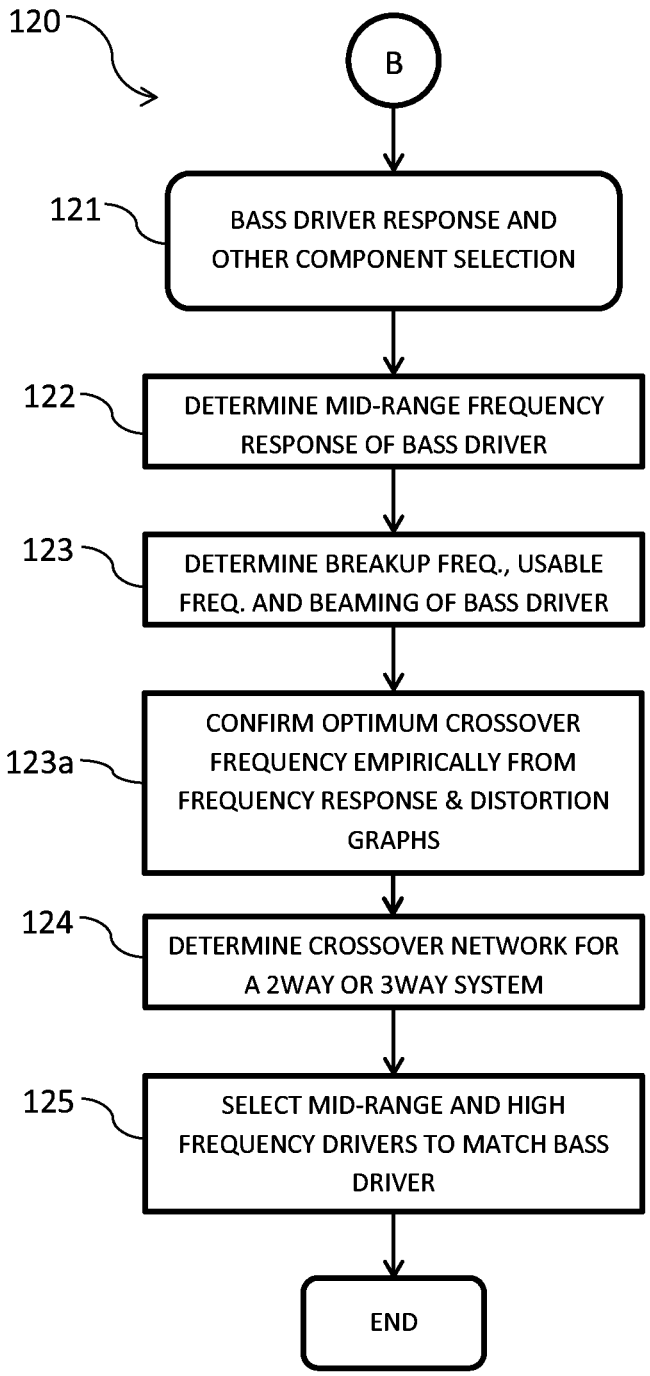
FIG. 19 shows the process B steps for using the midrange frequency response of the selected bass driver to determine the crossover network and the requirements for midrange or high frequency drivers.
Figure 20:
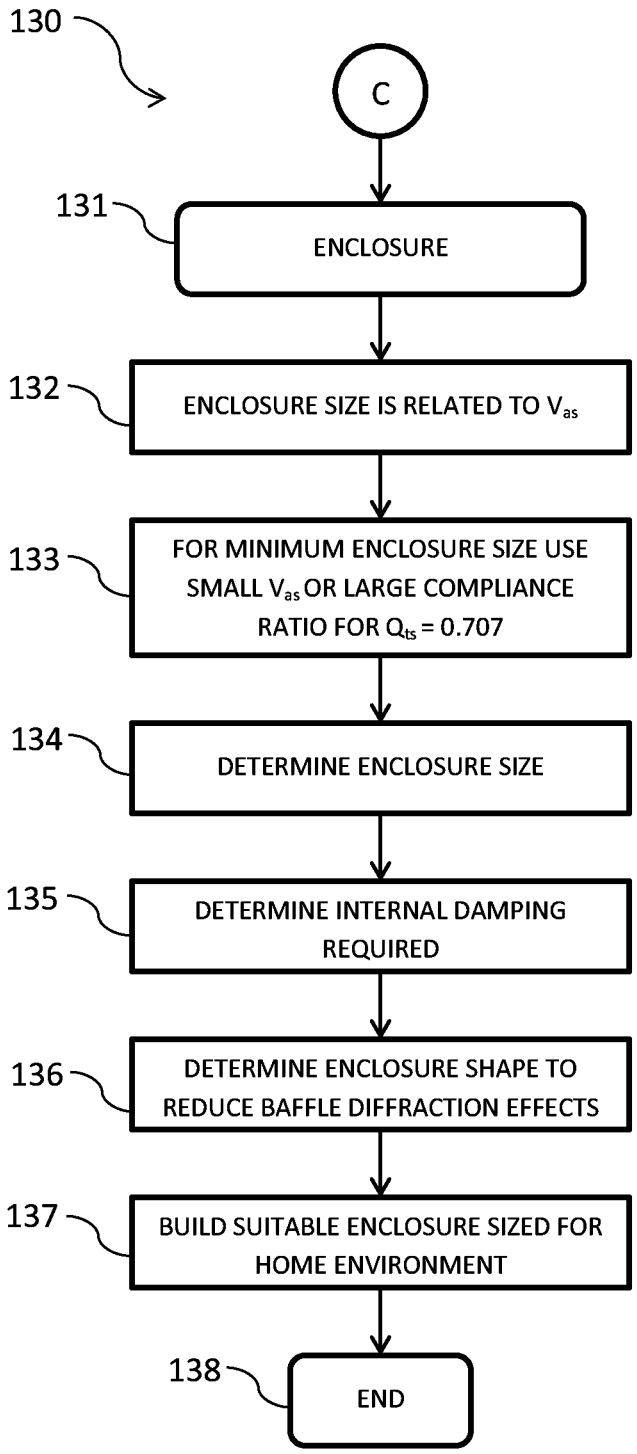
FIG. 20 shows the process C steps for determining the enclosure size and shape for the professional sound reinforcement drivers of the loudspeaker suitable for the audiophile or home environment.

FIG. 19 illustrates the steps 120 for determining the mid-range frequency response 122 of the bass driver 20. In order to understand and analyse the mid/high frequency performance of step 105 (FIG. 17), 122 (FIG. 19) of the selected bass driver 20, we must first look at and comprehend the woofer breakup modes, voice coil inductance and driver beaming as shown in step 123. The purpose of calculating these values is not to accurately determine what crossover point to use as some drivers with different cone geometries (for example curvilinear vs straight sided) don't follow these rules specifically. The calculations are an approximate guideline and discussion point to assist in determining what mid and high frequency requirements are likely for driver size. The actual crossover frequency and driver split is only truly determined empirically by looking at frequency response specifications from the driver manufacturer at step 123*a*.

Cone breakup occurs when the loudspeaker cone no longer behaves as a uniform air piston. At low frequencies a cone moves as a whole. This is the pistonic area of operation. At higher frequencies the cone starts to flex, leading to resonances. This is what is referred to as breakup. The cone changes from its pistonic frequency range of operation which is well modelled with T/S parameters to non pistonic. Analysing the resonances of the cone at the breakup frequencies, one would visibly see the cone shape of the woofer showing multiple flexing deformities and resultant multiple non uniform resonances across the cone surface. From a frequency response point of view this is often seen as sudden peaks and dips in SPL with intermodulation and harmonic distortions also being measurable in some cases. Breakup is often apparent with a spike in $2^{nd}$ order harmonic distortion and often ripples are also usually visible in the impedance curve. Breakup behaviour depends on cone material and geometry. Straight sided, ribbed and curvilinear cones all breakup differently and at different frequencies affecting their usable high frequency response. From a cone material perspective, paper has very well damped breakup modes, which is one reason why it is commonly used. More rigid materials, like metal, have very bad breakup modes, but fortunately they tend to be higher in frequency and so can usually be avoided with careful crossover design.

Voice Coil Inductance is another consideration. The voice coil of a loudspeaker driver, whilst having a fixed winding resistance, is in essence an inductor. There are both mechanical and electrical Thevenin equivalents to model a loudspeaker, but for simplicity we are interested in the inductance. The impedance of an inductor is given by Equation 10.

$$X(\Omega)=2\pi f^{*}L \qquad \text{Equation 10}$$

Thus from the formula above, as frequency increases, so does the impedance of the inductive voice coil resulting in less power for the same output voltage of the audio amplifier.

Driver beaming has been identified as probably the most critical influence on the limitation of mid frequency performance of a bass driver 20 as it generally occurs before both cone breakup and sufficient impedance due to inductance taking effect. Considerable driver beaming generally occurs at frequencies with wavelengths smaller than the diameter of the loudspeaker cone and thus affects the directivity of the driver at those frequencies. This is called beaming, as the driver produces sound at a narrowing beam directly in front of the driver as the frequency increases. Above the beaming frequency the driver off-axis response begins to drop considerably in SPL in comparison to the on-axis response. The driver has become increasingly directional and is approaching both its breakup modes and the effects of the voice coil inductance. Experimentation has shown that most drivers are usable up to about 1.5 times the beam frequency (providing the target aim is focussed primarily on the performance of on-axis response) and at twice the beam frequency most drivers are at their breakup modes. It is also important to note that the maximum usable frequency, determined experimentally through measurements, is also close to the frequency where the 'ka' (cone circumference over wavelength) value is 3.83. The maximum frequency without lobing for a particular driver occurs at a 'ka' value of 3.83. Above the usable frequency, drivers are very directional with SPL significantly reduced off-axis. At the breakup frequency, not only is the frequency response no longer smooth, but there is usually an increase in intermodulation and harmonic distortion affecting the fidelity of sound. The driver beaming frequency is calculated using Equation 11.

$$C=f^{*}A \qquad \text{Equation 11}$$

In this instance λ equals the cone diameter in meters and f equals the beaming frequency we are trying to calculate. The speed of sound in air (C) is as before 346 m/s at 25° C. Table 15 shows the beam frequency, estimated usable frequency and estimated breakup frequency for 15, 18 and 21 inch bass drivers 20.

TABLE 15

| Driver Diameter (Inches) | 15 | 18 | 21 |
|---|---|---|---|
| Driver Diameter (m) | 0.38 | 0.46 | 0.53 |
| Typical Cone Diameter (m) | 0.34 | 0.40 | 0.47 |
| Calculated Beam Frequency (Hz) | 1000 | 850 | 740 |
| Usable Upper Frequency (Hz) | 1500 | 1250 | 1000 |
| Estimated Breakup Frequency (Hz) | 2000 | 1700 | 1500 |

The next step 106, 124 is to determine a suitable crossover network. Such networks are formed by the combination of capacitors, inductors, and resistors and are designed to direct high frequencies to the tweeter driver 30 and low frequencies to the bass driver 20 in a two way system. A three-way crossover network divides the frequency range between the bass driver 20, the tweeter driver 30 and a mid-range driver 40.

Table 15 above gives valuable insight into what the crossover requirements could look like for the loudspeaker 10. In the event that we would like to use a bass driver up to its usable frequency, a low pass second order filter −12 dB per octave is required to ensure that the crossover began attenuating at the beam frequency, have a cut-off frequency equal to the usable upper frequency and be well attenuated −12 dB or better at the expected breakup frequency. Thus a usable crossover design for a two way system for an 18 inch driver theoretically would require a −3 dB or −6 dB frequency (depending on filter design e.g. Linkwitz-Riley, Butterworth) of about 1200 Hz and be −12 dB at 1700 Hz.

In the example of a two way system we might want to pair the 18 inch driver with a high frequency driver that has a usable response to at least 1200 Hz. This is ultimately determined on a driver by driver basis empirically by looking at the frequency response curve. In a three way arrangement, the requirements on the lower end of high frequency driver would be reduced as the mid-range driver 40 would fill some of the spectrum allowing for the bass driver 20 to be crossed over much lower and the high frequency driver 30 to be crossed over much higher.

For passive crossover network designs there are a number of topologies of filter design including Butterworth and Linkwitz-Riley. A Butterworth filter is calculated to have a cut-off frequency of −3 dB and a Linkwitz-Riley arrangement has a cut-off of −6 dB. Both of these, for second order designs are −12 dB/octave and will result in a phase shift of 180 degrees between the low pass 54 and high pass 53 filter requiring the high frequency driver (in a 2 way system) to be wired with reverse polarity to correct the phase error.

Figure 6:
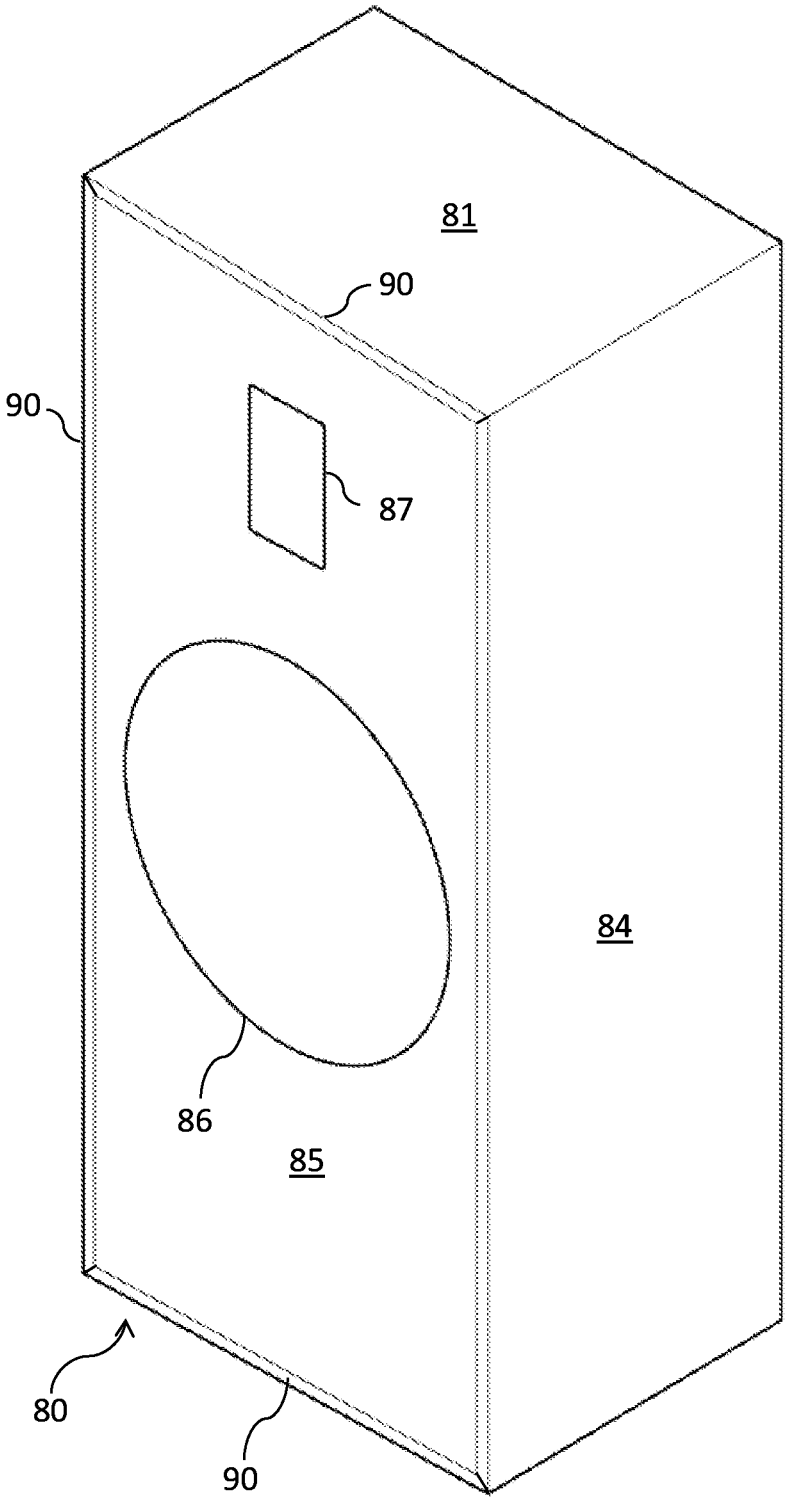
FIG. 6 shows a perspective view of a speaker enclosure in accordance with an embodiment of the present invention.
Figure 7:
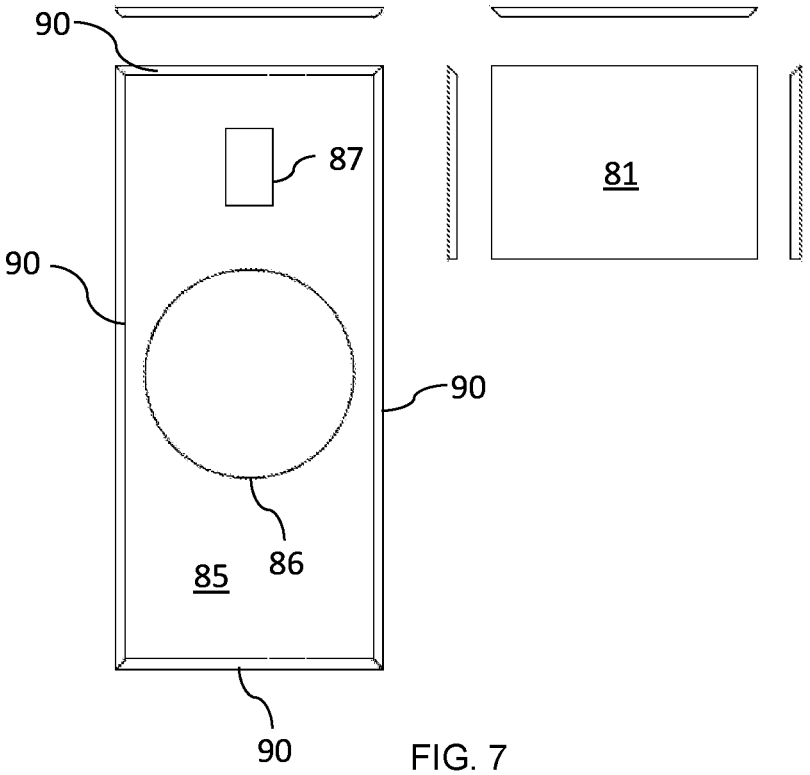
FIG. 7 shows the perspective, front and top and/or, bottom views of a speaker enclosure of FIG. 6.
Figure 8:
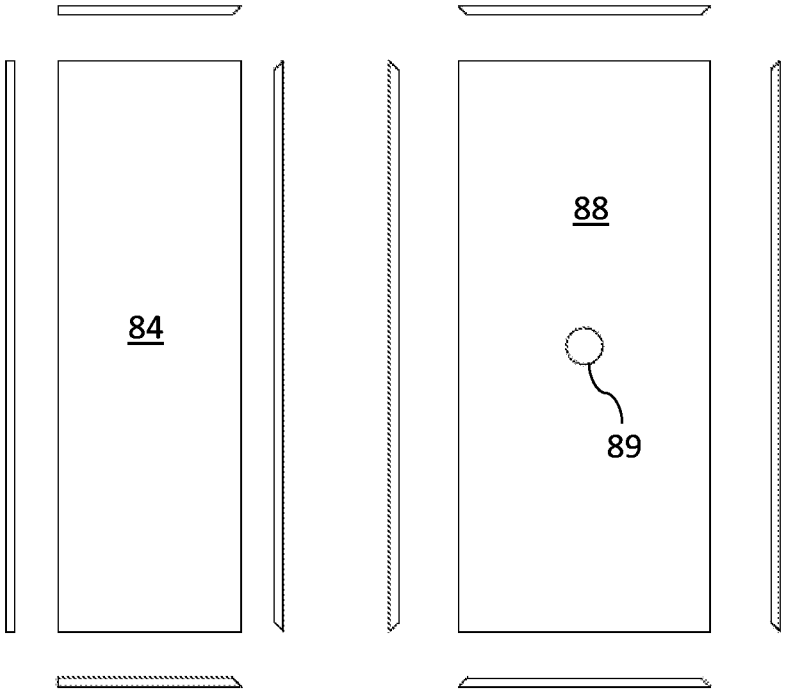
FIG. 8 shows the perspective side and rear views of the speaker enclosure of FIG. 6.
Figure 9:
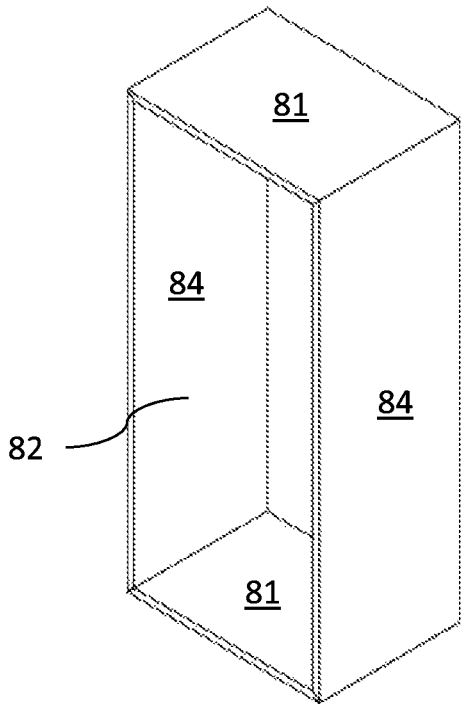
FIG. 9 shows an assembled front view of the speaker enclosure of FIG. 6 without the front baffle attached.
Figure 10:
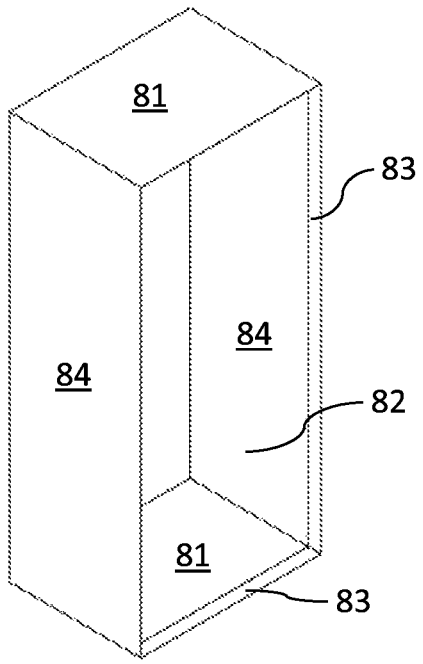
FIG. 10 shows an assembled rear view of the speaker enclosure of FIG. 6 without the rear panel attached.

Impedance correction is another factor to consider due to rising bass driver impedance with frequency as a result of voice coil inductance. If correction is required, a resistor in series with a capacitor and connected in parallel with the driver can provide impedance correction. This is known as a Zobel network 70. This can be determined by the loudspeaker impedance curve, the nominal target impedance and the capacitor impedance formula. The impedance of a capacitor is given by Equation 12 and the combined impedance of a Zobel network is given by Equation 13. An impedance correction schematic is shown in FIG. 6.

$$X_C(\Omega) = \frac{1}{2\pi f * C} \quad \text{Equation 12}$$

$$Z_{ZOBEL}(\Omega) = \sqrt{\left(\frac{1}{2\pi f * C}\right)^2 + R^2} \quad \text{Equation 13}$$

The next step in the process 100 is to select suitable mid-range and high frequency drivers 40, 30 which match the selected bass driver 20. This is step 107, 125 in the process. There are hundreds of midrange and tweeter driver 40, 30 combinations that could be used to match suitable bass drivers 20. The key to selecting the correct matching drivers 30, 40 falls to a number of key points. Power handling requirements to suitably match the bass driver 20, usable frequency of the high frequency and mid frequency drivers 30, 40 to ensure the complete audio spectrum is covered, dispersion characteristics to match the low frequency driver 20 and critically the mid and high frequency sensitivities to align with the bass driver 20 sensitivity.

Mid and high frequency drivers 40, 30 with significantly greater sensitivities can be used, but attenuation (using resistors and L-pads) are required to ensure a flat response. This is most common in designs based on compression drivers. Power handling selection poses its own challenges but as the majority of the power distribution in music is in the bass octaves, most designs have an 80-20 power rating split between the bass driver 20 and midrange and tweeter drivers 40, 30. As an example, a bass driver or woofer 20 rated at 80 W should use midrange and tweeter drivers 40, 30 with ratings of at least 20 W.

Audio spectrum coverage should have an evenly split octave distribution between drivers 20, 30, 40. In a two way design (based on the 10 critical music octaves from 31 Hz to <16000 Hz) a crossover frequency of 1000 Hz will result in a 5 octave split between the two drivers 20, 30. For a three way design, things are more difficult.

Often considered an ideal scenario is four octaves to the bass driver 20 (31-500 Hz), three Octaves to the midrange driver 40 (500-4000 Hz) and three octaves to the tweeter driver 30 (4000-<16000 Hz). All options have their fan base and preferences are subjective between listeners. The aim here is to try and create a full smooth frequency response with as little variation across the spectrum as possible and a seamless transition between frequency ranges of the different driver combinations. As will be illustrated further below a suitable combination for the loudspeaker 10 will be selected.

TABLE 16

| Bass Driver | Bass Driver Frequency Range | Sensitivity (dB) | Topology/Crossover |
|---|---|---|---|
| Beyma 18LX60V2 | 50-1200 Hz (anechoic)<br>25-1200 Hz (in-room) | 98 | 2 Way ($2^{nd}$ Order Linkwitz Riley Filter) |
| Beyma 18LX60V2 | 50-500 Hz (anechoic)<br>27-500 Hz (in-room) | 98 | 3 Way ($2^{nd}$ Order Linkwitz Riley Filter) |
| Beyma 18G40 | 55-1200 Hz (anechoic)<br>30-1200 Hz (in-room) | 97 | 2 Way ($2^{nd}$ Order Linkwitz Riley Filter) |
| Beyma 18G40 | 55-1200 Hz (anechoic)<br>30-1200 Hz (in-room) | 97 | 3 Way ($2^{nd}$ Order Linkwitz Riley Filter) |
| Beyma 18PWB1000Fe | 50-500 Hz (anechoic)<br>28-500 Hz (in-room) | 96 | 3 Way ($2^{nd}$ Order Linkwitz Riley Filter) |
| BMS 18N862 | 50-400 Hz (anechoic)<br>28-400 Hz (in-room) | 95 | 3 Way ($2^{nd}$ Order Linkwitz Riley Filter) + Attenuation |
| Peavey Low Rider 18 | 48-1000 Hz (anechoic)<br>25-1000 Hz (in-room) | 97 | 2 Way ($2^{nd}$ Order Linkwitz Riley Filter) + Attenuation |
| RCF LF21X451 | 50-400 Hz (anechoic)<br>28-400 Hz (in-room) | 97 | 3 Way ($2^{nd}$ Order Linkwitz Riley Filter) + Attenuation |
| Beyma 21PW1400Fe | 60-1000 Hz (anechoic)<br>35-1000 Hz (in-room) | 99 | 2 Way ($2^{nd}$ Order Linkwitz Riley Filter) |
| Beyma 21PW1400Fe | 60-400 Hz (anechoic)<br>35-400 Hz (in-room) | 99 | 3 Way ($2^{nd}$ Order Linkwitz Riley Filter) |
| Beyma 21PW1400Fe | 60-400 Hz (anechoic)<br>35-400 Hz (in-room) | 99 | 3 Way ($2^{nd}$ Order Linkwitz Riley Filter) |

| Bass Driver | Midrange & Tweeter Options | Midrange/Tweeter Sensitivities (dB) | Midrange/Tweeter Frequency Range |
|---|---|---|---|
| Beyma 18LX60V2 | Beyma TPL150 | 99 | 1200-23000 Hz |
| Beyma 18LX60V2 | Beyma 6MCF200Nd | 97 + | 500-4000 Hz + |

TABLE 16-continued

| | | | |
|---|---|---|---|
| | Beyma TPL150 | 99 | 4000-23000 Hz |
| Beyma 18G40 | Beyma TPL150 | 99 | 1200-23000 Hz |
| Beyma 18G40 | Beyma 6MCF200Nd | 97 + | 500-4000 Hz + |
| | Beyma TPL150 | 99 | 4000-23000 Hz |
| Beyma 18PWB1000Fe | Beyma 6MCF200Nd | 97 + | 500-4000 Hz + |
| | Beyma TPL150 | 99 | 4000-23000 Hz |
| BMS 18N862 | Beyma 10MCF400N | 102 + | 400-4000 Hz + |
| | Ciare 1.38TW | 105 | 4000-20000 Hz |
| Peavey Low Rider 18 | Beyma TPL150H | 102 | 1000-23000 Hz |
| RCF LF21X451 | RCF MR10N301 | 102 + | 400-2000 Hz |
| | Beyma TPL150H | 102 | 2000-23000 Hz |
| Beyma 21PW1400Fe | Beyma TPL150H | 102 | 1000-23000 Hz |
| Beyma 21PW1400Fe | RCF MR10N301 | 102 + | 400-2000 Hz |
| | Beyma TPL150H | 102 | 2000-23000 Hz |
| Beyma 21PW1400Fe | Beyma 6MCF200Nd | 97 + | 500-4000 Hz |
| | Beyma TPL150 | 99 | 4000-23000 Hz |

Table 16 shows a number of examples of complete system designs for a selection of some of the bass drivers 20 (Table 14) modelled with a suitable crossover 50. Some designs require attenuation of the mid-range and high frequency drivers 40, 30 (with a series crossover resistor) to match bass driver sensitivity and a Zobel network 70 to flatten the impedance of the bass driver 20. The list is not exhaustive and additional or new driver combinations not in Table 16 may meet the criteria discussed.

For the prototype design as illustrated in FIG. 3 a two way system has been chosen with a bass driver 20 and high frequency tweeter driver 30. Table 17 shows the topography of such a design.

TABLE 17

| Bass Driver | Bass Driver Frequency Range | Sensitivity (dB) |
|---|---|---|
| Beyma 18LX60V2 | 50-1200 Hz (anechoic)<br>25-1200 Hz (in-room) | 98 |
| **Tweeter Option** | **Tweeter Frequency Range** | **Sensitivity (dB)** |
| Beyma TPL150 | 1200-23000 Hz | 99 |
| Topology/Crossover | 2 Way (2nd Order Linkwitz Riley Filter) | |

The $2^{nd}$ Order Linkwitz Riley Filter is calculated using Equations 14 and 15.

$$L = \frac{0.3183 * Z}{f} \quad \text{Equation 14}$$

-continued $$C = \frac{0.0796}{Z * f} \quad \text{Equation 15}$$

For the prototype two way design loudspeaker 10 using the drivers 20, 30 identified in Table 17, the crossover network filter 50 design using a $2^{nd}$ order Linkwitz-Riley filter, and Zobel filter 70, the following components were initially calculated and then fine-tuned after measurement for the loudspeaker design and are shown in Table 18 and FIG. 5. Table 19 shows the on-axis frequency response specifications for the two way speaker system 10.

TABLE 18

| Driver | Nominal Impedance | Bass Driver Cut-off Frequency | | |
|---|---|---|---|---|
| Beyma 18LX60V2 | 8 ohms | Low Pass 1200 Hz | | |
| Beyma TPL150 | 8 ohms (5 ohms for Calculation) | High Pass 1200 Hz | | |
| **Driver** | **Topology/Crossover** | **Cap Value** | **L Value** | **−6 dB Freq.** |
| Beyma 18LX60V2 | 2 Way ($2^{nd}$ Order Linkwitz Riley Filter) | C1 = 10uF | L2 = 2.2 mH | 1200 Hz |
| Beyma TPL150 | 2 Way ($2^{nd}$ Order Linkwitz Riley Filter) | C3 = 16uF | L3 = 0.47 mH | 1200 Hz |
| Zobel Network | | | | |
| Zobel Z@1200 Hz | 12 Ω | Driver Z@1200 Hz | 13 Ω | Driver + Zobel Z @ 1200 Hz | 6.2 Ω |
| Zobel Components | C = 16 uF | R = 8.2 Ω | | |

TABLE 19

| Criteria | Nominal Impedance | Frequency Response | Sensitivity | Total Deviation |
|---|---|---|---|---|
| On-Axis (Anechoic) | 8 ohms | 50-20000 Hz | 98 dB 1 W/m | +/−3 dB |
| On-Axis (In-Room) | 8 ohms | 25-20000 Hz | 98 dB 1 W/m | +/−3 dB |
| **Criteria** | **Average Deviation from Mean** | **−6 dB Point** | **Power Rating (AES)** | |
| On-Axis (Anechoic) | 2 dB | 38 Hz | 500 | |
| On-Axis (In-Room) | 2 dB | 19 Hz | 500 | |

This ends 126 the process of analysing the bass driver 20 and determining suitable crossover networks 50 and mid-range and high frequency drivers 40, 30. The next step 108, 130 in the process 100 is to design a suitable enclosure 10, 80 to house the bass driver 20 and either or both the tweeter driver 30 and mid-range driver 40. One of the key challenges to be solved with the design process 100 is providing an appropriate sized enclosure 10, 80 to house the bass and high frequency professional sound reinforcement drivers 20, 30 which is suitably sized for the home and audiophile markets.

As is shown in FIG. 3, the prototype enclosure is a rectangular box enclosure with a chamfered baffle plate forming a sealed enclosure. However as noted above other shaped enclosures can be utilised without departing from the scope of the present invention. The first step 131 is to note that the enclosure size is related to the compliance volume (Vas). The next step 132 is to determine the Vas for the available professional sound reinforcement drivers for a sealed enclosure, which is found in Table 13. In order to achieve a small enclosure suitable for the audiophile and home user environment in step 133 the compliance volume must be small or you require a large compliance ratio ($\alpha$) for an optimum total driver quality (Qts) of 0.707. With this information now obtained the next step is to determine the enclosure size at step 134.

By way of example only, the prototype two way system enclosure 10 has a Beyma 18LX60V2 bass driver 20 and a Beyma TPL150 mid and high frequency driver 30. The enclosure 10 has an enclosure volume of 220 L which also compensates for internal bracing and bass driver 20 volume displacement. The case is 1200 mm high by 530 mm wide and has a depth of 410 mm. The case is constructed from 18 mm and 24 mm thick birch wood ply with the internal bracing timber cornices and beams. The present invention provides a sealed loudspeaker where the sound reinforcement driver acts as a bracing strut in the internal bracing. The bass driver 20 forms a part of the bracing for the sealed loudspeaker 10.

Critically material density and thickness play a large part of the selection process for the enclosure 10. In all aspects of a sealed enclosure, regardless of materials chosen, it is important to ensure the enclosure is well sealed and well braced. One must factor into the design the volume occupied by the bracing and add this to the determined box dimension calculations, although this can be in part compensated by the addition of sufficient damping material. At step 135 we determine the required internal damping material. In the prototype the damping material is a synthetic polyester fabric or fibre such as Dacron. In order to reduce enclosure resonances, a damping material is placed inside the interior space of the enclosure 10. The next step is to determine the shape of the enclosure at step 136. As described above the prototype enclosure is a rectangular box enclosure with a chamfered front panel to minimise diffraction effects.

The final step 137 is to build the enclosure 10 and perform the required testing and measurement to ensure the designed prototype meets the design requirement. With a number of computer programs available the testing and measurement of the prototype design can be automated and therefore quick to obtain the results. The sub-process of designing the appropriate enclosure 130 is completed at step 138 which ends the process or method of designing a sealed loudspeaker 10 for the home and audiophile markets.

Figure 13:
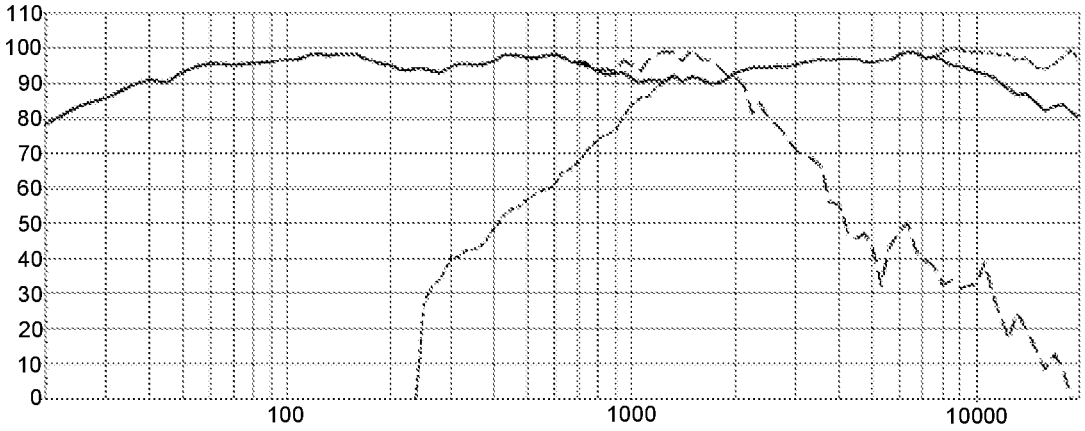
FIG. 13 shows the modelled 30 degrees off-axis frequency response for the loudspeaker of FIG. 1 expected in an anechoic chamber.
Figure 15:
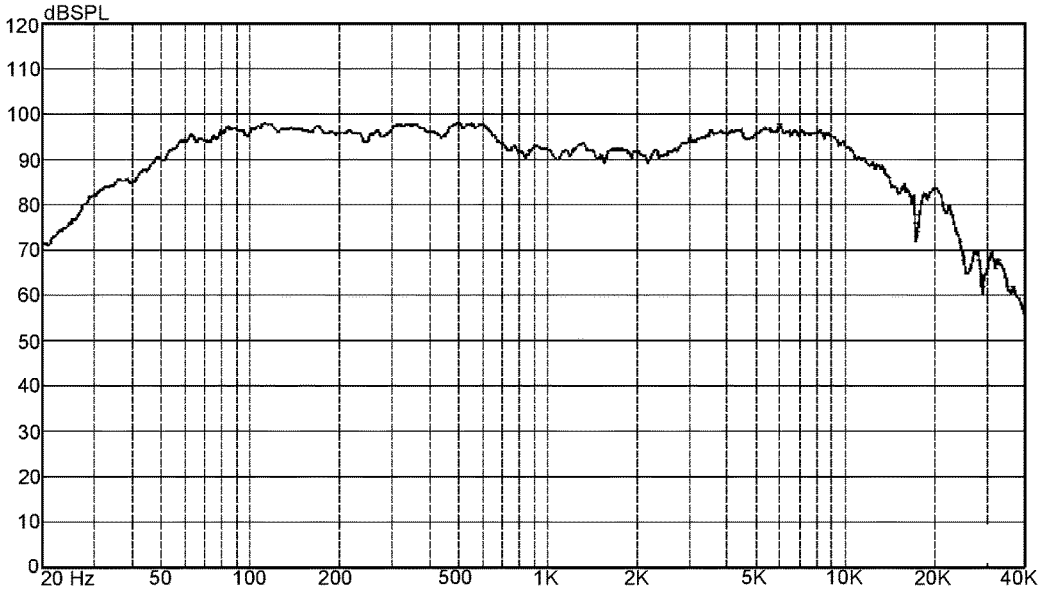
FIG. 15 shows the actual half space ground plane measured 30 degree off-axis frequency response for the built prototype of FIG. 3.

Reviewing the measurements of the completed system shows some interesting off-axis response characteristics worth discussing. One of the benefits not apparent from using a large low frequency driver to a usable frequency above the calculated beam frequency is the potential for creating a slightly attenuated off-axis response in the mid frequencies. Whilst this may not seem like a benefit, room measurements show that it can help to remove wall reflections and thus improve vocal imaging on-axis. The characteristic dish shaped curve which has been named the "μ" curve becomes more apparent when we look at the crossover options. In a prototype design with an 18 or 21 inch driver where the driver output has narrowed off-axis above 1000 Hz due to beaming, we are forced to crossover the high frequency driver also at a low frequency where its efficiency is generally slightly lower. This can work well if the high frequency driver has a low resonant frequency and reasonable power handling. It is for this reason that the "μ" curve exists in off-axis measurements. This has been both modelled and measured and is another characteristic of using this design methodology when the appropriate drivers are selected. The 30 degree off-axis "μ" curve modelled and measured are shown in FIGS. 13 and 15. That is FIG. 13 shows the modelled 30 degree off-axis frequency response for the loudspeaker 10 which is expected in an anechoic chamber.

The speaker's contribution to the early reflected sound is the frequency response at the off axis angles that represent the sound path from loudspeaker to boundary to the listener. FIG. 15 shows the actual half space ground plane measured 30 degree off-axis frequency response achieved by the prototype of the loudspeaker 10. The graph shown in FIG. 15, shows the resulting SPL in dB mapped over the frequency range. In comparing the two graphs, we can see that both the modelled and actual off-axis graphs are comparable in particular as noted above at 1000 Hz both outputs narrow.

Figure 16:
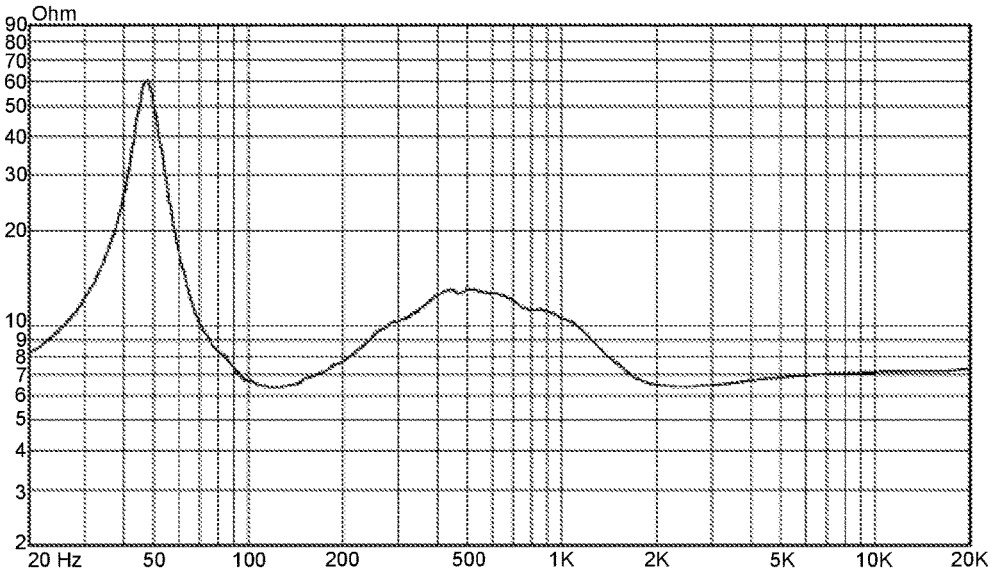
FIG. 16 shows the measured impedance curve with an enclosure tuning frequency of the prototype of approximately 50 Hz.

Looking further into the measurements, FIG. 16 illustrates the measured impedance curve with an enclosure tuning frequency of the prototype of approximately 50 Hz. The present invention as tested is a 2-way loudspeaker, having an impedance correction Zobel network across the woofer to dampen the rising impedance cause by its voice coil inductance and a crossover network with a conventional 12 dB/octave parallel design.

As illustrated, speaker impedance is not a single value, instead, it changes with frequency. The most notable feature of the impedance curve is the impedance peak located at the system resonant frequency. The resonant frequency or driver resonance in the enclosure is approximately 60 ohms (Zmax) at 48 Hz (Fc). Using Small's analysis methods, we can verify our enclosure tuning Qtc and compare this to the modelled design. To do this we require a number of pieces of information which are already available from the impedance curve (FIG. 16) and the dc resistance of the speaker system. The loudspeaker system has a dc resistance (Re) measured at approximately 5.6 ohms. This is expected as the driver data sheet indicated an (Re) of 5.1 ohms and the additional wiring and dc resistance of crossover components in the enclosure was expected to be in the range of 0.4-0.5 ohms in addition to the bass driver's (Re). The first step in the process of analysing the system's low frequency performance is to determine the ratio of the peak impedance to the systems (Re), this ratio is to be called (rc) and is given by equation 16 below.

$$rc = \frac{Zmax}{Re} \qquad \text{Equation 16}$$

From Equation 16 this yields an (rc) equal to 10.7. Next we need to determine from the impedance graph (FIG. 16) the two frequencies above (F2) and below (F1) of (Fc) where the impedance is equal to Equation 17.

$$Z_{(F1,F2)} = Re * \sqrt{rc} \qquad \text{Equation 17}$$

This yields a Z of 18.33 ohms with the frequencies equal to this impedance taken from FIG. 16 being approximately 37 Hz (F1) and 58 Hz (F2). With these identified, we are able to calculate the complete enclosure's mechanical Q from Equation 18 using (Fc), (F1), (F2) and (rc) calculated above.

$$Qmc = \frac{Fc * \sqrt{rc}}{F2 - F1} \quad \text{Equation 18}$$

This results in a Qmc=7.48 and from the Qmc we can determine the loudspeaker system Qtc from Equation 19.

$$Qtc = \frac{Qmc}{rc} \quad \text{Equation 19}$$

This gives a total system Qtc of 0.698. Table 20 shows the comparison between the modelled design and the measured tuning as determined from FIG. 16.

TABLE 20

| Target Fb = F3 = Fb(ζ) | Measured Fb | Target Qtc @ Fb(ζ) | Measured Qtc |
|---|---|---|---|
| 50 Hz | 48 Hz | 0.707 | 0.698 |

In addition we can also verify the actual F3 point from FIG. 14 and this is shown in Table 21.

TABLE 21

| Target Sensitivity (dB) | Measured Sensitivity (dB) | Target dB @ Fb(ζ) | Measured dB @ Measured Fb |
|---|---|---|---|
| 98 | 97 | −3 dB = (95 dB) | −3.2 dB = (93.8 dB) |

To summarise the driver selection process in greater detail now that the design method has been verified, Table 22 shows the selection criteria for a bass driver 20 for a sealed enclosure loudspeaker 10 limited to an enclosure volume of 250 L and Fb=F3=Fb(ζ)=50 Hz suitable for the audiophile and home environment. It is evident that for the desired sealed frequency threshold of 50 Hz and a reference efficiency of the bass driver greater than 1.5%, that the enclosure volume ranges from 95 L to 250 L, the ratio α ranges from 7 to 0.65, and the total driver quality (Qts) ranges from 0.25 to 0.55 for a total quality of the system (Qtc) of 0.7.

TABLE 22

| Fs | 18 | 19 | 20 | 21 | 22 | 23 | 24 | 25 |
|---|---|---|---|---|---|---|---|---|
| Fb(ζ) | 50 | 50 | 50 | 50 | 50 | 50 | 50 | 50 |
| Qtc | 0.7 | 0.7 | 0.7 | 0.7 | 0.7 | 0.7 | 0.7 | 0.7 |
| Qts | 0.25 | 0.27 | 0.28 | 0.30 | 0.31 | 0.33 | 0.34 | 0.35 |
| ~Qes | 0.25 | 0.27 | 0.28 | 0.30 | 0.31 | 0.33 | 0.34 | 0.35 |
| α | 7 | 5.86 | 5.38 | 4.55 | 4.2 | 3.59 | 3.32 | 3.08 |
| Vb | 95-250 | 100-250 | 105-250 | 110-250 | 110-250 | 120-250 | 120-250 | 120-250 |
| Vas | 680-1750 | 630-1500 | 560-1350 | 510-1150 | 470-1050 | 430-900 | 390-840 | 360-770 |
| η0 | 1.5-3.9% | 1.5-3.6% | 1.5-3.6% | 1.5-3.4% | 1.5-3.4% | 1.5-3.2% | 1.5-3.2% | 1.5-3.2% |

| Fs | 26 | 27 | 28 | 29 | 30 | 31 | 32 | 33 |
|---|---|---|---|---|---|---|---|---|
| Fb(ζ) | 50 | 50 | 50 | 50 | 50 | 50 | 50 | 50 |
| Qtc | 0.7 | 0.7 | 0.7 | 0.7 | 0.7 | 0.7 | 0.7 | 0.7 |
| Qts | 0.37 | 0.38 | 0.40 | 0.41 | 0.42 | 0.44 | 0.45 | 0.47 |
| ~Qes | 0.37 | 0.38 | 0.40 | 0.41 | 0.42 | 0.44 | 0.45 | 0.47 |
| α | 2.65 | 2.46 | 2.12 | 1.97 | 1.83 | 1.58 | 1.46 | 1.26 |
| Vb | 125-250 | 125-250 | 135-250 | 135-250 | 135-250 | 145-250 | 145-250 | 160-250 |
| Vas | 330-670 | 300-615 | 290-530 | 265-500 | 245-460 | 230-400 | 215-370 | 205-315 |
| η0 | 1.5-3.0% | 1.5-3.0% | 1.5-2.8% | 1.5-2.8% | 1.5-2.8% | 1.5-2.6% | 1.5-2.6% | 1.5-2.3% |

| Fs | 34 | 35 | 36 | 37 | 38 | 39 |
|---|---|---|---|---|---|---|
| Fb(ζ) | 50 | 50 | 50 | 50 | 50 | 50 |
| Qtc | 0.7 | 0.7 | 0.7 | 0.7 | 0.7 | 0.7 |
| Qts | 0.48 | 0.49 | 0.51 | 0.52 | 0.54 | 0.55 |
| ~Qes | 0.48 | 0.49 | 0.51 | 0.52 | 0.54 | 0.55 |
| α | 1.17 | 1.08 | 0.92 | 0.85 | 0.71 | 0.65 |
| Vb | 160-250 | 170-250 | 185-250 | 190-250 | 215-250 | 225-550 |
| Vas | 190-290 | 180-270 | 170-230 | 160-215 | 155-180 | 145-165 |
| η0 | 1.5-2.3% | 1.5-2.2% | 1.5-2.0% | 1.5-2.0% | 1.5-1.8% | 1.5-1.7% |

Table 23 shows the theoretical selection criteria for the bass driver 20 for a sealed enclosure loudspeaker 10 limited to an enclosure volume of 250 L and Fb=F3=45 Hz which is suitable for the audiophile and home environment. The table shows that with a sealed frequency threshold of 45 Hz, the reference efficiency of the bass driver 20 is greater than 1.5% up to a resonant frequency (Fs) of 32 Hz, likewise the enclosure volume exceeds the 250 L at above Fs of 32 Hz for a total quality of the system (Qtc) of 0.7.

TABLE 23

| Fs | 18 | 19 | 20 | 21 | 22 | 23 | 24 | 25 |
|---|---|---|---|---|---|---|---|---|
| Fb | 45 | 45 | 45 | 45 | 45 | 45 | 45 | 45 |
| Qtc | 0.7 | 0.7 | 0.7 | 0.7 | 0.7 | 0.7 | 0.7 | 0.7 |
| Qts | 0.28 | 0.30 | 0.31 | 0.33 | 0.35 | 0.36 | 0.38 | 0.39 |
| ~Qes | 0.28 | 0.30 | 0.31 | 0.33 | 0.35 | 0.36 | 0.38 | 0.39 |
| α | 5.25 | 4.61 | 4.06 | 3.59 | 3.18 | 2.83 | 2.51 | 2.24 |
| Vb | 140-250 | 150-250 | 155-250 | 160-250 | 165-255 | 170-250 | 175-250 | 175-250 |
| Vas | 755-1345 | 690-1140 | 620-1020 | 560-900 | 520-770 | 465-710 | 435-615 | 400-570 |
| η0 | 1.5-2.7% | 1.5-2.5% | 1.5-2.5% | 1.5-2.5% | 1.5-2.2% | 1.5-2.2% | 1.5-2.1% | 1.5-2.1% |

| Fs | 26 | 27 | 28 | 29 | 30 | 31 | 32 | 33 |
|---|---|---|---|---|---|---|---|---|
| Fb | 45 | 45 | 45 | 45 | 45 | 45 | 45 | 45 |
| Qtc | 0.7 | 0.7 | 0.7 | 0.7 | 0.7 | 0.7 | 0.7 | 0.7 |
| Qts | 0.41 | 0.42 | 0.44 | 0.46 | 0.47 | 0.49 | 0.50 | 0.52 |
| ~Qes | 0.41 | 0.42 | 0.44 | 0.46 | 0.47 | 0.49 | 0.50 | 0.52 |
| α | 1.99 | 1.78 | 1.58 | 1.41 | 1.25 | 1.11 | 0.98 | 0.86 |
| Vb | 180-250 | 180-250 | 200-250 | 215-250 | 220-250 | 235-250 | 240-250 | N/A |
| Vas | 365-490 | 335-455 | 315-400 | 295-340 | 275-315 | 260-270 | 240-250 | N/A |
| η0 | 1.5-2.0% | 1.5-2.0% | 1.5-1.9% | 1.5-1.7% | 1.5-1.7% | 1.5-1.6% | 1.5-1.6% | N/A |

| Fs | 34 | 35 | 36 | 37 | 38 | 39 |
|---|---|---|---|---|---|---|
| Fb | 45 | 45 | 45 | 45 | 45 | 45 |
| Qtc | 0.7 | 0.7 | 0.7 | 0.7 | 0.7 | 0.7 |
| Qts | 0.53 | 0.55 | 0.57 | 0.58 | 0.60 | 0.61 |
| ~Qes | 0.53 | 0.55 | 0.57 | 0.58 | 0.60 | 0.61 |
| α | 0.75 | 0.65 | 0.56 | 0.48 | 0.40 | 0.33 |
| Vb | N/A | N/A | N/A | N/A | N/A | N/A |
| Vas | N/A | N/A | N/A | N/A | N/A | N/A |
| η0 | N/A | N/A | N/A | N/A | N/A | N/A |

Table 24 shows the theoretical selection criteria for the bass driver 20 for a sealed enclosure loudspeaker 10 limited to an enclosure volume of 250 L and Fb=F3=40 Hz which is suitable for the audiophile and home environment. The table shows that with a sealed frequency threshold of 40 Hz, the reference efficiency of the bass driver 20 is greater than 1.5% up to a resonant frequency of only (Fs) of 22 Hz, likewise the enclosure volume exceeds the 250 L at above Fs of 22 Hz for a total quality of the system (Qtc) of 0.7.

TABLE 24

| Fs | 18 | 19 | 20 | 21 | 22 | 23 | 24 | 25 |
|---|---|---|---|---|---|---|---|---|
| Fb | 40 | 40 | 40 | 40 | 40 | 40 | 40 | 40 |
| Qtc | 0.7 | 0.7 | 0.7 | 0.7 | 0.7 | 0.7 | 0.7 | 0.7 |
| Qts | 0.32 | 0.34 | 0.35 | 0.37 | 0.39 | 0.41 | 0.42 | 0.44 |
| ~Qes | 0.32 | 0.34 | 0.35 | 0.37 | 0.39 | 0.41 | 0.42 | 0.44 |
| α | 3.88 | 3.32 | 3.08 | 2.65 | 2.29 | 1.97 | 1.83 | 1.58 |
| Vb | 210-250 | 230-250 | 230-250 | 235-250 | 250 | N/A | N/A | N/A |
| Vas | 860-970 | 780-830 | 700-750 | 630-660 | 580 | N/A | N/A | N/A |
| η0 | 1.5-1.7% | 1.5-1.6% | 1.5-1.6% | 1.5-1.6% | 1.5% | N/A | N/A | N/A |

| Fs | 26 | 27 | 28 | 29 | 30 | 31 | 32 | 33 |
|---|---|---|---|---|---|---|---|---|
| Fb | 40 | 40 | 40 | 40 | 40 | 40 | 40 | 40 |
| Qtc | 0.7 | 0.7 | 0.7 | 0.7 | 0.7 | 0.7 | 0.7 | 0.7 |
| Qts | 0.46 | 0.47 | 0.49 | 0.51 | 0.53 | 0.55 | 0.57 | 0.58 |
| ~Qes | 0.46 | 0.47 | 0.49 | 0.51 | 0.53 | 0.55 | 0.57 | 0.58 |
| α | 1.36 | 1.26 | 1.08 | 0.92 | 0.79 | 0.65 | 0.54 | 0.49 |
| Vb | N/A | N/A | N/A | N/A | N/A | N/A | N/A | N/A |
| Vas | N/A | N/A | N/A | N/A | N/A | N/A | N/A | N/A |
| η0 | N/A | N/A | N/A | N/A | N/A | N/A | N/A | N/A |

TABLE 24-continued

| Fs | 34 | 35 | 36 | 37 | 38 | 39 |
|---|---|---|---|---|---|---|
| Fb | 40 | 40 | 40 | 40 | 40 | 40 |
| Qtc | 0.7 | 0.7 | 0.7 | 0.7 | 0.7 | 0.7 |
| Qts | 0.60 | 0.62 | 0.64 | 0.65 | 0.67 | 0.69 |
| ~Qes | 0.60 | 0.62 | 0.64 | 0.65 | 0.67 | 0.69 |
| α | 0.39 | 0.30 | 0.22 | 0.18 | 0.11 | 0.05 |
| Vb | N/A | N/A | N/A | N/A | N/A | N/A |
| Vas | N/A | N/A | N/A | N/A | N/A | N/A |
| η0 | N/A | N/A | N/A | N/A | N/A | N/A |

Table 25 highlights examples of unsuitable professional sound reinforcement drivers for high fidelity small sealed enclosures based on the selection criteria of Table 22. As is shown, each of the loudspeakers listed would not be suitable for the reasons listed in Table 26.

TABLE 25

| Speaker Driver Model | Size (in) | Fs (Hz) | Target F(ζ) (Hz) | Actual Fb, F3 (Hz) | Vas (L) |
|---|---|---|---|---|---|
| Beyma 18P80Nd | 18 | 30 | 50 | 74 | 411 |
| JBL 2241H | 18 | 35 | 50 | 88 | 283 |
| RCF MB15H401 | 15 | 44 | 50 | 104 | 121 |
| Beyma SM-118/N | 18 | 42 | 50 | 51 | 206 |
| P Audio P180-2241 Mk II | 18 | 40 | 50 | 48 | 233 |
| Eminence Beta-15A | 15 | 35 | 50 | 43 | 335 |

| Speaker Driver Model | Qts | α | Ref. Efficiency | 0.707 Qtc Box Vol (L) |
|---|---|---|---|---|
| Beyma 18P80Nd | 0.29 | 4.94 | 3.7% | 85 |
| JBL 2241H | 0.28 | 5.38 | 4.0% | 55 |
| RCF MB15H401 | 0.30 | 4.55 | 3.1% | 25 |
| Beyma SM-118/N | 0.58 | 0.49 | 2.3% | 420 |
| P Audio P180-2241 Mk II | 0.59 | 0.44 | 2.0% | 530 |
| Eminence Beta-15A | 0.58 | 0.49 | 2.1% | 690 |

TABLE 26

| Speaker Driver Model | Suitability Issue |
|---|---|
| Beyma 18P80Nd | F3 much higher than target 50 Hz |
| JBL 2241H | F3 much higher than target 50 Hz |
| RCF MB15H401 | F3 much higher than target 50 Hz |
| Beyma SM-118/N | Very large enclosure requirement - High Qtc enclosure required to reduce size with transient response issues. |
| P Audio P180-2241 Mk II | Very large enclosure requirement - High Qtc enclosure required to reduce size with transient response issues. |
| Eminence Beta-15A | Very large enclosure requirement - High Qtc enclosure required to reduce size with transient response issues. |

It will be apparent to persons skilled in the art that a number of variations and modifications can be made without departing from the scope of the invention as defined in the claims.

ADVANTAGES

It will be apparent that the present invention relates generally to a sealed loudspeaker for the home and audiophile markets. To date, Hi-Fi loudspeakers designed for the home and audiophile market have not employed sealed designs based on professional sound reinforcement drivers (PA speakers). This is largely due to the fact that, for the majority of these drivers to operate effectively they require either a very large enclosure and or ported enclosure design. The present process has shown that a small range of these PA bass drivers with certain characteristics (Thiele and Small Parameters) exist that can form the basis of true High Fidelity loudspeaker system design for the audiophile and home user environment.

Such designs have many benefits over conventional Hi-Fi application loudspeaker designs. Professional sound reinforcement drivers have an advantage over standard Hi-Fi drivers as a result of their diaphragm surface area and also their efficiency. Likewise the amount of power required to drive a professional sound reinforcement driver to reach the 100 dB threshold for an enclosure designed to have an F3 (−3 dB) frequency of 50 Hz is considerably lower than that required to drive a conventional Hi-Fi driver.

Sealed enclosures have a gentle low frequency roll off (12 db/octave below Fb) and a better transient response than ported enclosures. Any efficiency loss and higher Fb of a sealed enclosure can be partially compensated by the high efficiency of the professional sound reinforcement driver and this type of driver has several other advantages over normal Hi-Fi loudspeaker drivers. The advantages of these drivers include: lower distortion at the same sound output level of Hi-Fi speakers due to the increased efficiency, less power requirements for the same SPL, a large surface area to reproduce low frequencies with less cone excursion and a greater dynamic range. These drivers are also desirable, in that professional sound reinforcement drivers have subtle tone characteristics that are desired by live performers, difficult to quantify and which conventional Hi-Fi loudspeaker systems struggle to reproduce.

The advantages provided by the present sealed enclosure are further highlighted by the disadvantages of other speaker designs. For example, to design an enclosure for a professional sound reinforcement driver for a very low cut-off frequency with a vented enclosure design would mean providing a very large enclosure which would be unsuitable for the home environment. Likewise vented designs have a poorer transient response. Similarly, a comparable horn loaded design would require a massive or very large enclosure in order to achieve a wide fidelity range. The size of the horn loaded enclosure would make it unsuitable for the home environment. This is also the case for any transmission line enclosure for a professional sound reinforcement driver.

The sealed enclosure design of the present invention has a gentle low frequency roll off (12 db/octave below Fb) and a better transient response than ported or vented enclosures. Any efficiency loss and higher Fb of a sealed enclosure can be partially compensated by the high efficiency of the professional sound reinforcement driver.

The present invention provides a sealed loudspeaker and the process of providing such a speaker for the home and audiophile markets using professional sound reinforcement drivers (PA). The present invention also provides the required characteristics needed to produce high fidelity bass drivers based on the PA driver topologies that can be used to build high end Hi-Fi audiophile loudspeaker systems for the home environment. The process provides the characteristics required for a suitable driver with a low frequency cut-off, high efficiency and good transient response which is suitable for the home environment. The design of an enclosure which will house the above mentioned driver is of a size which will allow the driver to be used in the home environment. This both means the present invention provides a sealed loudspeaker which is both visually appealing while remaining of a size which complements the home environment.

Another advantage or benefit not apparent from using a large low frequency driver to a usable frequency above the calculated beam frequency is the potential for creating a slightly attenuated off-axis response in the mid-frequencies. Whilst this may not seem like a benefit, room measurements show that it does help to remove wall reflections and thus improve vocal imaging on-axis.

The present invention provides a sealed loudspeaker with a substantially flat on-axis response and both the on and off-axis response curves are similar in shape, therefore providing a sealed loudspeaker where the early reflected and late reflected sound as heard in a room will be similar in spectral balance to the direct sound.

Variations

It will be realised that the foregoing has been given by way of illustrative example only and that all other modifications and variations as would be apparent to persons skilled in the art are deemed to fall within the broad scope and ambit of the invention as herein set forth.

The term "driver" is used throughout the following discussion to describe the individual sound-generating elements of a loudspeaker. In this context, the term "driver" is interchangeable with terms such as "radiator" or "panel", and, for specific elements of the speaker, with terms such as the "woofer" or low-frequency element, the "tweeter" or high-frequency element, etc.

The electrical "crossover frequency" between drivers is defined as the frequency at which the drivers have equal voltage input. The acoustic "crossover frequency" is defined as the frequency where both drivers have equal SPL.

The "effective" diameter of a driver is the perimeter of the vibrating element divided by Pi. The nominal diameter of a circular driver is its advertised diameter. The "effective" moving area of a driver generally includes the cone diameter plus one third of the width of the surround.

A sound reinforcement "bass driver" refers to the low frequency element of a sound reinforcement co-axial transducer, sound reinforcement full range loudspeaker e.g. with Whizzer Cone, a woofer or a subwoofer.

Various substantially and specifically practical and useful exemplary embodiments of the claimed subject matter, are described herein, textually and/or graphically, including the best mode, if any, known to the inventors for carrying out the claimed subject matter. Variations (e.g., modifications and/or enhancements) of one or more embodiments described herein might become apparent to those of ordinary skill in the art upon reading this application. The inventor expects skilled artisans to employ such variations as appropriate, and the inventor intend for the claimed subject matter to be practiced other than as specifically described herein. Accordingly, as permitted by law, the claimed subject matter includes and covers all equivalents of the claimed subject matter and all improvements to the claimed subject matter. Moreover, every combination of the above described elements, activities, and all possible variations thereof are encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

Thus, regardless of the content of any portion (e.g., title, field, background, summary, description, abstract, drawing figure, etc.) of this application, unless clearly specified to the contrary, such as via explicit definition, assertion, or argument, or clearly contradicted by context, with respect to any claim, whether of this application and/or any claim of any application claiming priority hereto, and whether originally presented or otherwise:

(a) there is no requirement for the inclusion of any particular described or illustrated characteristic, function, activity, or element, any particular sequence of activities, or any particular interrelationship of elements;

(b) no characteristic, function, activity, or element is "essential";

(c) any elements can be integrated, segregated, and/or duplicated;

(d) any activity can be repeated, any activity can be performed by multiple entities, and/or any activity can be performed in multiple jurisdictions; and (e) any activity or element can be specifically excluded, the sequence of activities can vary, and/or the interrelationship of elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The invention claimed is:

1. A method of designing a sealed loudspeaker for the home and audiophile markets, the method comprising the steps of:

(a) determining a list of required characteristics which form a basis for a high fidelity driver;

(b) calculating a preferred value for each of the characteristics in step (a);

(c) matching the preferred value characteristics with a bass professional sound reinforcement driver selected from a list of professional sound reinforcement drivers;

(d) determining a midrange frequency response for the selected bass driver from step (c), the mid-range frequency response is used to analyse the mid/high frequency performance of the bass driver to define an estimated breakup frequency, a usable upper frequency, and a driver beaming frequency of the bass driver;

(e) calculating an appropriate crossover network filter for at least a 2-way loudspeaker;

(f) selecting an appropriate high frequency professional sound reinforcement driver to match the bass driver selected in step (c) and the crossover network calculated in step (e); and (g) designing an enclosure which has a volume of less than 300 Liters to house the bass and high frequency professional sound reinforcement drivers sized for the home and audiophile markets, and wherein the bass driver has a compliance volume in the range of 140 to 1800 Liters, a system compliance ratio ($\alpha$) less than 7.0, and a reference efficiency of greater than 1.5% for a total system quality of between 0.5 and 1.0.

2. A method as claimed in claim 1, wherein the matched bass driver selected in step (c) has a driver diameter of between 15 inches to 21 inches.

3. A method as claimed in claim 2, wherein the designed enclosure in step (g) has a volume of less than 250 Liters and the total system quality of 0.707.

4. A method as claimed in claim 1, wherein step (e) further comprises calculating an appropriate crossover network filter for a 3-way loudspeaker.

5. A method as claimed in claim 4, wherein for the 3-way loudspeaker, step (f) further comprises selecting an appropriate midrange professional sound reinforcement driver to match the bass driver selected in step (c) and the crossover network calculated in step (e).

6. A method as claimed in claim 1, wherein the required characteristics of step (a) are experimentally determined through an audio testing setup to determine for the sealed enclosure loudspeaker:

(i) a driver free air resonant frequency; and (ii) a minimum usable total driver quality.

7. A method as claimed in claim 6, wherein the experimentally determined characteristics are further refined by calculating a practical driver or total driver quality for a set desirable sealed cut-off frequency or resonant frequency of 50 Hz or less for an enclosure total quality of the system of between 0.5 and 1.0.

8. A method as claimed in claim 7, wherein a compliance volume is determined to fulfil the desirable sealed cut-off frequency of 50 Hz or less while limiting an enclosure volume to less than 250 Liters.

9. A method as claimed in claim 8, further comprising calculating a reference efficiency of the driver using:

(i) the compliance volume; and (ii) the total driver quality as an approximate electrical Q factor.

10. A method as claimed in claim 9, wherein the professional sound reinforcement driver is further limited to any driver that has a free air resonant frequency of less than 40 Hz, to achieve an efficiency of greater than 1.5% with a flat response to the desired target frequency of 50 Hz or less in a sealed enclosure limited to a volume of no greater than 250 Liters.

11. A method as claimed in claim 10, wherein a driver maximum compliance volume and a driver minimum compliance volume is calculated to meet the efficiency of greater than 1.5%.

12. A method as claimed in claim 11, wherein a table of usable selection characteristics is produced for the selection of the professional sound reinforcement bass driver that will provide a 70 Hz or below cut-off frequency in a sealed enclosure of less than 300 Liters with a total quality of the system of between 0.5 and 1.0.

13. A method as claimed in claim 12, wherein designing the enclosure in step (g) comprises a cabinet housing the professional sound reinforcement bass and high frequency drivers designed to project sound from the cabinet while leaving a space inside the cabinet that is unoccupied by the professional sound reinforcement bass and high frequency drivers, the cabinet and the professional sound reinforcement drivers forming a sealed enclosure.

14. A method as claimed in claim 13, wherein designing the enclosure in step (g) further comprises adding a damping material mounted in the space inside the cabinet to minimise internal resonances.

15. A method as claimed in claim 14, wherein designing the enclosure in step (g) further comprises forming the cabinet in any shape.

16. A method as claimed in claim 15, wherein designing the enclosure in step (g) further comprises forming the cabinet in a rectangular box shape and bevelling at least one edge on a front surface of the cabinet to reduce baffle diffraction effects.

17. A method as claimed in claim 16, wherein designing the enclosure in step (g) further comprises providing internal bracing to minimise the amplitude of vibration when exposed to a time varying internal pressure.

18. A method of designing a professional sound reinforcement driver for a sealed loudspeaker for the home and audiophile markets, the method comprising the steps of:

(a) determining a list of required characteristics which form a basis for a high fidelity driver;

(b) calculating a preferred value for each of the characteristics in step (a);

(c) matching the preferred value characteristics with a professional sound reinforcement driver selected from a list of professional sound reinforcement drivers;

(d) determining a midrange frequency response for the matched selected driver from step (c), the mid-range frequency response is used to analyse the mid/high frequency performance of the selected driver to; define an estimated breakup frequency, a usable upper frequency, and a driver beaming frequency of the selected driver; and (e) designing a sealed enclosure which has a volume of less than 300 Liters to house the professional sound reinforcement driver which is suitably sized for the home and audiophile markets and has a compliance volume in the range of 140 to 1800 Liters, a system compliance ratio ($\alpha$) less than 7.0, and a reference efficiency of greater than 1.5% for a total system quality of between 0.5 and 1.0.

19. A method as claimed in claim 18, wherein the driver is selected from any one or more of:

(i) a bass driver;

(ii) a midrange driver;

(iii) a high frequency driver;

(iv) a coaxial driver; or (v) a subwoofer driver.

20. A method as claimed in claim 17, further comprising providing the sealed loudspeaker with a flat on-axis response and both the on-axis and an off-axis frequency response curves are substantially similar in shape, the shape of the on-axis and off-axis curves are substantially u-shaped curves.

* * * * *